US011871809B2

(12) United States Patent
Lowe

(10) Patent No.: US 11,871,809 B2
(45) **Date of Patent: *Jan. 16, 2024**

(54) MULTI-LAYER HELMET AND METHOD FOR MAKING THE SAME

(71) Applicant: Bell Sports, Inc., Scotts Valley, CA (US)

(72) Inventor: Michael W. Lowe, Santa Cruz, CA (US)

(73) Assignee: Bell Sports, Inc., Scotts Valley, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/711,196

(22) Filed: Apr. 1, 2022

(65) Prior Publication Data

US 2022/0330647 A1 Oct. 20, 2022

Related U.S. Application Data

(63) Continuation of application No. 16/525,263, filed on Jul. 29, 2019, now Pat. No. 11,291,263, which is a (Continued)

(51) Int. Cl.
*A42B 3/12* (2006.01)
*A42B 3/06* (2006.01)

(52) U.S. Cl.
CPC ..... *A42B 3/128* (2013.01); *A42B 3/064* (2013.01)

(58) Field of Classification Search
CPC ..... A42B 3/128; A42B 3/064
See application file for complete search history.

(56) References Cited

U.S. PATENT DOCUMENTS 1,060,220 A 4/1913 White
1,172,406 A 2/1916 Taylor
(Continued)

FOREIGN PATENT DOCUMENTS

CA 2778050 A1 4/2011
CH 692011 1/2002
(Continued)

OTHER PUBLICATIONS

Rawlings Fall/Winter Sports Catalog 1926-1927.
(Continued)

*Primary Examiner* — Bao-Thieu L Nguyen
(74) *Attorney, Agent, or Firm* — Barnes & Thornburg LLP

(57) ABSTRACT

A protective helmet to be worn by a player engaged in a sport comprises a flexible outer shell and a multi-layer liner assembly disposed within the outer shell. The multi-layer liner assembly includes an inner-layer, a middle-layer and an outer-layer, and permits relative rotational movement between said layers when the helmet is worn by the player and receives an impact. The inner-layer is made from a first material with a first density and is mechanically coupled to the outer-layer without adhesive. The outer-layer is made from a second material with a second density that is greater than the first density of the inner-layer. The middle-layer is made from a third material that has a third density that is greater than the first density. The outer-layer also has a thickness that is greater than a thickness of the inner-layer and varies between a front region of the outer-layer and a crown region of the outer-layer.

40 Claims, 10 Drawing Sheets

Related U.S. Application Data continuation of application No. 14/563,003, filed on Dec. 8, 2014, now Pat. No. 10,362,829.

(60) Provisional application No. 61/913,222, filed on Dec. 6, 2013.

(56) References Cited

U.S. PATENT DOCUMENTS

| | | | |
|---|---|---|---|
| 1,203,564 | A | 11/1916 | April |
| 1,262,818 | A | 4/1918 | Mcgill |
| 1,449,183 | A | 3/1923 | Johnstone |
| 1,522,952 | A | 1/1925 | Goldsmith |
| 1,655,007 | A | 1/1928 | Boettge |
| 1,691,202 | A | 11/1928 | La Reabourne |
| 1,705,879 | A | 3/1929 | Rodgers |
| 1,833,708 | A | 11/1931 | Ford |
| 1,868,926 | A | 7/1932 | Tatore |
| 1,892,943 | A | 1/1933 | Geyer |
| 2,140,716 | A | 12/1938 | Pryale |
| 2,150,290 | A | 3/1939 | Mulvey |
| 2,194,903 | A | 3/1940 | Holstein |
| 2,250,275 | A | 7/1941 | Riddell |
| 2,264,931 | A | 12/1941 | Wright |
| 2,296,335 | A | 9/1942 | Brady |
| 2,354,840 | A | 8/1944 | Seletz |
| 2,359,387 | A | 10/1944 | Riddell |
| 2,451,483 | A | 10/1948 | Goldsmith |
| 2,525,389 | A | 10/1950 | Zeller |
| 2,570,182 | A | 10/1951 | Daly |
| 2,634,415 | A | 4/1953 | Turner |
| 2,679,046 | A | 5/1954 | Dye |
| 2,688,747 | A | 9/1954 | Marx |
| 2,758,304 | A | 8/1956 | Mcgowan |
| 2,768,380 | A | 10/1956 | Golomb |
| 2,777,127 | A | 1/1957 | Marietta |
| 2,785,405 | A | 3/1957 | Snyder |
| D180,239 | S | 5/1957 | Mcmurry |
| 2,850,740 | A | 9/1958 | Adams |
| 2,861,272 | A | 11/1958 | Stuart |
| 2,867,811 | A | 1/1959 | Jones |
| 2,890,457 | A | 6/1959 | Marietta |
| 2,904,645 | A | 9/1959 | Sarles |
| 2,944,263 | A | 7/1960 | Rayburn |
| 2,969,546 | A | 1/1961 | Morgan, Jr. |
| 2,985,883 | A | 5/1961 | Marietta |
| 2,986,739 | A | 6/1961 | Rozzi, Sr. |
| 3,039,108 | A | 6/1962 | Lohrenz |
| 3,039,109 | A | 6/1962 | Simpson |
| 3,082,427 | A | 3/1963 | Zbikowski |
| 3,106,716 | A | 10/1963 | Beebe |
| 3,113,318 | A | 12/1963 | Marietta |
| 3,153,973 | A | 10/1964 | Marietta |
| 3,155,981 | A | 11/1964 | Mckissick |
| 3,166,761 | A | 1/1965 | Strohm |
| 3,167,783 | A | 2/1965 | Wolfe |
| 3,174,155 | A | 3/1965 | Pitman |
| 3,186,004 | A | 6/1965 | Carlini |
| 3,187,342 | A | 6/1965 | Aileo |
| 3,189,917 | A | 6/1965 | Sims |
| 3,197,784 | A | 8/1965 | Carlisle |
| 3,208,080 | A | 9/1965 | Hirsch |
| 3,216,023 | A | 11/1965 | Morgan |
| 3,223,086 | A | 12/1965 | Denton |
| 3,263,236 | A | 8/1966 | Humphrey |
| 3,274,612 | A | 9/1966 | Merriam |
| 3,274,613 | A | 9/1966 | Sowle |
| 3,283,336 | A | 11/1966 | Critser |
| 3,292,180 | A | 12/1966 | Marietta |
| 3,296,582 | A | 1/1967 | Ide |
| 3,315,272 | A | 4/1967 | Olt |
| 3,323,134 | A | 6/1967 | Swyers |
| 3,327,313 | A | 6/1967 | Oliver |
| 3,344,433 | A | 10/1967 | Stapenhill |
| 3,364,499 | A | 1/1968 | Kwoka |
| 3,447,162 | A | 6/1969 | Aileo |
| 3,447,163 | A | 6/1969 | Bothwell |
| 3,462,763 | A | 8/1969 | Schneider |
| 3,478,365 | A | 11/1969 | Varga |
| 3,500,472 | A | 3/1970 | Castellani |
| 3,548,409 | A | 12/1970 | Aileo |
| 3,548,410 | A | 12/1970 | Parker |
| 3,566,409 | A | 3/1971 | Hopper |
| 3,568,210 | A | 3/1971 | Marietta |
| 3,577,562 | A | 5/1971 | Holt |
| 3,590,388 | A | 7/1971 | Holt |
| 3,600,714 | A | 8/1971 | Greathouse |
| 3,605,113 | A | 9/1971 | Marietta |
| 3,609,764 | A | 10/1971 | Morgan |
| 3,616,463 | A | 11/1971 | Theodore |
| 3,619,813 | A | 11/1971 | Marchello |
| 3,629,864 | A | 12/1971 | Latina |
| 3,713,640 | A | 1/1973 | Margan |
| 3,720,955 | A | 3/1973 | Rawlings |
| 3,729,744 | A | 5/1973 | Rappleyea |
| 3,761,959 | A | 10/1973 | Dunning |
| 3,783,450 | A | 1/1974 | O Connor |
| 3,785,395 | A | 1/1974 | Andreasson |
| 3,787,895 | A | 1/1974 | Belvedere |
| 3,793,241 | A | 2/1974 | Kyler |
| D230,911 | S | 3/1974 | Ispas |
| 3,815,152 | A | 6/1974 | Bednarczuk |
| 3,818,508 | A | 6/1974 | Lammers |
| 3,820,163 | A | 6/1974 | Rappleyea |
| 3,843,970 | A | 10/1974 | Marietta |
| 3,849,801 | A | 11/1974 | Holt |
| 3,854,146 | A | 12/1974 | Dunning |
| 3,872,511 | A | 3/1975 | Nichols |
| 3,882,547 | A | 5/1975 | Morgan |
| 3,916,446 | A | 11/1975 | Gooding |
| 3,934,271 | A | 1/1976 | Rhee |
| 3,946,441 | A | 3/1976 | Johnson |
| 3,992,721 | A | 11/1976 | Morton |
| 3,994,020 | A | 11/1976 | Villari |
| 3,994,021 | A | 11/1976 | Villari |
| 3,994,022 | A | 11/1976 | Villari |
| 3,999,220 | A | 12/1976 | Keltner |
| 4,006,496 | A | 2/1977 | Marker |
| 4,023,209 | A | 5/1977 | Frieder |
| 4,023,213 | A | 5/1977 | Rovani |
| 4,028,743 | A | 6/1977 | Christensen |
| 4,035,847 | A | 7/1977 | Prince |
| 4,038,700 | A | 8/1977 | Gyory |
| 4,044,400 | A | 8/1977 | Lewicki |
| 4,054,953 | A | 10/1977 | De Barsy |
| 4,060,855 | A | 12/1977 | Rappleyea |
| 4,064,565 | A | 12/1977 | Griffiths |
| 4,075,714 | A | 2/1978 | Ryder |
| 4,086,664 | A | 5/1978 | Humphrey |
| 4,101,983 | A | 7/1978 | Dera |
| 4,233,687 | A | 11/1980 | Lancellotti |
| 4,272,853 | A | 6/1981 | Schuessler |
| 4,279,038 | A | 7/1981 | Brueckner |
| 4,282,610 | A | 8/1981 | Steigerwald |
| 4,287,613 | A | 9/1981 | Schulz |
| 4,307,471 | A | 12/1981 | Lovell |
| 4,345,338 | A | 8/1982 | Frieder, Jr. |
| 4,354,284 | A | 10/1982 | Gooding |
| D267,287 | S | 12/1982 | Gooding |
| 4,363,140 | A | 12/1982 | Correale |
| 4,370,759 | A | 2/1983 | Zide |
| 4,375,108 | A | 3/1983 | Gooding |
| 4,390,995 | A | 7/1983 | Walck |
| 4,398,306 | A | 8/1983 | Gooding |
| 4,404,690 | A | 9/1983 | Farquharson |
| D271,249 | S | 11/1983 | Farquharson |
| 4,432,099 | A | 2/1984 | Grick |
| 4,434,514 | A | 3/1984 | Sundahl |
| 4,461,044 | A | 7/1984 | Reiterman |
| 4,463,456 | A | 8/1984 | Hanson |
| 4,475,248 | A | 10/1984 | L Abbe |
| 4,477,929 | A | 10/1984 | Mattsson |
| 4,478,587 | A | 10/1984 | Mackal |
| 4,534,068 | A | 8/1985 | Mitchell |
| 4,555,816 | A | 12/1985 | Broersma |

(56) References Cited

U.S. PATENT DOCUMENTS 4,566,137 A 1/1986 Gooding
4,627,115 A 12/1986 Broersma
4,633,531 A 1/1987 Nimmons
4,646,368 A 3/1987 Infusino
4,651,356 A 3/1987 Zide
4,665,569 A 5/1987 Santini
4,677,694 A 7/1987 Crow
4,692,947 A 9/1987 Black
4,706,305 A 11/1987 Cho
4,724,549 A 2/1988 Herder
4,741,054 A 5/1988 Mattes
4,744,107 A 5/1988 Foehl
4,766,614 A 8/1988 Cantwell
4,774,729 A 10/1988 Coates
4,794,652 A 1/1989 Piech Von Planta
4,808,469 A 2/1989 Hiles
4,821,344 A 4/1989 Kamata
4,831,668 A 5/1989 Schulz
4,837,866 A 6/1989 Rector
4,853,980 A 8/1989 Zarotti
4,866,792 A 9/1989 Arai
4,885,806 A 12/1989 Heller
4,885,807 A 12/1989 Snow, Jr.
4,903,346 A 2/1990 Reddemann
4,916,759 A 4/1990 Arai
D309,512 S 7/1990 Crow
4,937,888 A 7/1990 Straus
4,947,490 A 8/1990 Hayden
4,982,452 A 1/1991 Chaise
4,996,724 A 3/1991 Dextrase
5,012,533 A 5/1991 Raffler
5,014,365 A 5/1991 Schulz
5,031,246 A 7/1991 Kronenberger
5,035,009 A * 7/1991 Wingo, Jr. ..... A42B 3/121 2/425
5,044,016 A 9/1991 Coombs
5,056,162 A * 10/1991 Tirums ..... A42C 2/007 2/909
5,083,321 A 1/1992 Davidsson
5,093,936 A 3/1992 Copeland
5,093,937 A 3/1992 Kamata
5,093,939 A 3/1992 Noyerie
5,101,517 A 4/1992 Douglas
5,129,108 A 7/1992 Copeland
5,136,728 A * 8/1992 Kamata ..... A42B 3/281 2/424
5,142,700 A 8/1992 Reed
5,150,479 A 9/1992 Oleson
5,165,116 A 11/1992 Simpson
D332,507 S 1/1993 Anderson
5,175,889 A 1/1993 Infusino
5,177,815 A 1/1993 Andujar
5,177,816 A 1/1993 Schmidt
5,204,998 A 4/1993 Liu
5,231,703 A 8/1993 Garneau
5,263,203 A 11/1993 Kraemer
5,263,204 A 11/1993 Butsch
5,267,353 A 12/1993 Milligan
5,271,103 A * 12/1993 Darnell ..... A42B 3/125 2/418
5,272,773 A 12/1993 Kamata
5,293,649 A 3/1994 Corpus
5,298,208 A 3/1994 Sibley
5,309,576 A 5/1994 Broersma
5,315,718 A 5/1994 Barson
RE34,699 E 8/1994 Copeland
D350,710 S 9/1994 Keiffer
5,345,614 A 9/1994 Tanaka
5,347,660 A 9/1994 Zide
D355,394 S 2/1995 Bezener
D357,555 S 4/1995 Brueckner
5,418,257 A 5/1995 Weisman
5,448,780 A * 9/1995 Gath ..... A42B 3/28 2/424
5,461,730 A 10/1995 Carrington
D364,487 S 11/1995 Tutton
5,493,736 A 2/1996 Allison
5,502,843 A 4/1996 Strickland
5,517,691 A * 5/1996 Blake ..... A42B 3/32 2/418
5,522,091 A 6/1996 Rudolf
5,539,936 A 7/1996 Thomas
5,544,367 A 8/1996 March, II
5,553,330 A 9/1996 Carveth
D378,236 S 2/1997 Zanotto
D378,624 S 3/1997 Chartrand
5,621,922 A 4/1997 Rush, III
D382,671 S 8/1997 Shewchenko
5,655,227 A 8/1997 Sundberg
D383,953 S 9/1997 DeFilippo
5,661,854 A * 9/1997 March, II ..... A42B 3/324 2/410
5,713,082 A 2/1998 Bassette
5,724,681 A 3/1998 Sykes
5,732,414 A 3/1998 Monica
5,734,994 A 4/1998 Rogers
5,737,770 A 4/1998 Chen
5,774,901 A 7/1998 Minami
5,790,988 A 8/1998 Guadagnino, Jr.
5,794,270 A 8/1998 Howat
5,794,271 A 8/1998 Hastings
5,794,274 A 8/1998 Kraemer
5,799,337 A 9/1998 Brown
5,833,796 A 11/1998 Matich
5,867,840 A 2/1999 Hirosawa
D406,399 S 3/1999 Hohdorf
5,883,145 A 3/1999 Hurley
D408,236 S 4/1999 Rennick
5,913,412 A 6/1999 Huber
5,915,537 A 6/1999 Dallas
5,915,819 A 6/1999 Gooding
5,930,840 A 8/1999 Arai
5,938,878 A 8/1999 Hurley
5,941,272 A 8/1999 Feldman
5,943,706 A 8/1999 Miyajima
5,946,735 A 9/1999 Bayes
5,950,244 A 9/1999 Fournier
5,953,761 A 9/1999 Jurga
5,956,777 A 9/1999 Popovich
5,963,990 A 10/1999 White
5,966,744 A 10/1999 Smith, Jr.
6,032,297 A 3/2000 Barthold
6,047,400 A 4/2000 Spencer
6,054,005 A 4/2000 Hurley
6,070,271 A 6/2000 Williams
6,073,271 A 6/2000 Alexander
6,079,053 A 6/2000 Clover, Jr.
6,081,932 A 7/2000 Kraemer
6,089,251 A 7/2000 Pestel
6,128,786 A 10/2000 Maddux
6,138,284 A 10/2000 Arai
6,154,889 A * 12/2000 Moore, III ..... A42B 3/06 2/418
6,159,324 A 12/2000 Watters
6,178,560 B1 1/2001 Halstead
6,189,156 B1 2/2001 Loiars
6,199,219 B1 3/2001 Silken
6,219,850 B1 4/2001 Halstead
6,226,801 B1 5/2001 Alexander
6,240,571 B1 6/2001 Infusino
D445,962 S 7/2001 Brignone
6,256,798 B1 7/2001 Egolf
6,261,042 B1 7/2001 Pratt
6,272,692 B1 8/2001 Abraham
D448,526 S 9/2001 Brignone
6,282,724 B1 9/2001 Abraham
6,282,726 B1 9/2001 Noyerie
D448,890 S 10/2001 Brignone
6,298,483 B1 10/2001 Schiebl
6,298,497 B1 10/2001 Chartrand
6,314,586 B1 11/2001 Duguid
6,324,701 B1 12/2001 Alexander
6,332,228 B1 12/2001 Takahara

(56) References Cited

U.S. PATENT DOCUMENTS 6,339,849 B1 1/2002 Nelson
D453,399 S 2/2002 Racine
6,351,853 B1 3/2002 Halstead
6,360,376 B1 3/2002 Carrington
6,370,699 B1 4/2002 Halstead
6,385,780 B1 5/2002 Racine
6,389,607 B1 5/2002 Wood
D459,032 S 6/2002 Gatellet
D459,554 S 6/2002 Gatellet
D459,555 S 6/2002 Gatellet
6,421,841 B2 7/2002 Ikeda
6,434,755 B1 8/2002 Halstead
6,438,762 B1 8/2002 Jenkins
6,438,763 B2 8/2002 Guay
6,446,270 B1 9/2002 Durr
D465,067 S 10/2002 Ide
6,467,099 B2 10/2002 Dennis
6,481,024 B1 11/2002 Grant
D466,651 S 12/2002 Halstead
6,499,139 B1 12/2002 Brown
6,499,147 B2 12/2002 Schiebl
D475,486 S 6/2003 Ide
6,604,246 B1 8/2003 Obreja
6,658,671 B1 12/2003 Von Holst
6,701,535 B2 3/2004 Dobbie
D492,818 S 7/2004 Ide
D495,838 S 9/2004 Arai
6,785,985 B2 9/2004 Marvin
6,826,509 B2 11/2004 Crisco, III
6,874,170 B1 4/2005 Aaron
6,880,176 B2 * 4/2005 Timms ..... A42B 3/28 2/184.5
6,925,657 B2 * 8/2005 Takahashi ..... A42B 3/128 2/412
6,931,671 B2 8/2005 Skiba
6,934,971 B2 8/2005 Ide
D509,928 S 9/2005 Barnoski
6,938,272 B1 9/2005 Brown
D511,026 S 10/2005 Ide
D512,534 S 12/2005 Maddux
D521,191 S 5/2006 Berger
D523,180 S 6/2006 Frye
7,062,795 B2 6/2006 Skiba
7,111,329 B2 9/2006 Stroud
7,140,049 B2 11/2006 Lang-Ree
7,146,652 B2 12/2006 Ide
7,240,376 B2 7/2007 Ide
7,243,378 B2 7/2007 Desarmaux
7,341,776 B1 3/2008 Milliren
D570,055 S 5/2008 Ferrara
D575,458 S 8/2008 Ho
D582,607 S 12/2008 Ferrara
7,328,462 B1 12/2008 Straus
D587,407 S 2/2009 Nimmons
D587,852 S 3/2009 Nimmons
D587,853 S 3/2009 Nimmons
D587,854 S 3/2009 Nimmons
D587,855 S 3/2009 Nimmons
D587,857 S 3/2009 Nimmons
D590,106 S 4/2009 Nimmons
D603,099 S 10/2009 Bologna
D603,100 S 10/2009 Bologna
7,607,179 B2 10/2009 Shih
D616,154 S 5/2010 Daniel
D617,503 S 6/2010 Szalkowski
7,735,157 B2 6/2010 Ikeda
7,743,640 B2 6/2010 Lampe
7,774,866 B2 8/2010 Ferrara
7,802,320 B2 9/2010 Morgan
D625,050 S 10/2010 Chen
7,832,023 B2 11/2010 Crisco
D628,748 S 12/2010 Stewart
D629,162 S 12/2010 Daniel
7,870,617 B2 1/2011 Butler
D633,658 S 3/2011 Daniel
7,900,279 B2 3/2011 Kraemer
7,917,972 B1 4/2011 Krueger
7,930,771 B2 4/2011 Depreitere
7,954,177 B2 6/2011 Ide
7,987,525 B2 8/2011 Summers
8,015,624 B2 * 9/2011 Baldackin ..... A42B 3/065 2/412
8,087,099 B2 1/2012 Sawabe
D654,227 S 2/2012 Stout
D654,629 S 2/2012 Chou
D654,630 S 2/2012 Chou
8,117,679 B2 2/2012 Pierce
8,156,569 B2 * 4/2012 Cripton ..... A42B 3/0473 2/6.8
8,191,179 B2 6/2012 Durocher
8,201,269 B2 6/2012 Maddux
D663,076 S 7/2012 Parsons
8,209,784 B2 7/2012 Maddux
D666,779 S 9/2012 Harris
8,296,867 B2 10/2012 Rudd
8,296,868 B2 * 10/2012 Belanger ..... A42B 3/324 2/420
D671,271 S 11/2012 Votel
8,328,159 B2 12/2012 Lee
D679,058 S 3/2013 Szalkowski
8,418,270 B2 4/2013 Desjardins
8,429,766 B2 4/2013 Halfaker
8,499,366 B2 8/2013 Nimmons
8,524,338 B2 9/2013 Anderson
8,544,117 B2 10/2013 Erb
8,544,118 B2 10/2013 Brine, III
8,566,968 B2 10/2013 Marzec
8,578,520 B2 11/2013 Halldin
8,640,267 B1 2/2014 Cohen
8,656,520 B2 2/2014 Rush, III
8,707,470 B1 4/2014 Novicky
8,719,967 B2 5/2014 Milsom
8,726,424 B2 5/2014 Thomas
8,739,317 B2 6/2014 Abernethy
8,756,719 B2 6/2014 Veazie
8,776,272 B1 7/2014 Straus
8,793,816 B2 8/2014 Larkin
8,813,269 B2 8/2014 Kraemer
8,814,150 B2 8/2014 Ferrara
8,826,468 B2 9/2014 Harris
8,850,622 B2 10/2014 Finiel
8,850,623 B1 10/2014 Mazzoccoli
8,887,312 B2 * 11/2014 Bhatnagar ..... B32B 5/26 2/2.5
8,887,318 B2 11/2014 Mazzarolo
8,955,169 B2 * 2/2015 Weber ..... A42B 3/125 2/425
8,966,671 B2 * 3/2015 Rumbaugh ..... A42B 3/065 2/412
9,017,806 B2 4/2015 Jacobsen
9,095,179 B2 8/2015 Kwan
9,107,466 B2 8/2015 Hoying
9,113,672 B2 * 8/2015 Witcher ..... A42B 3/121
9,119,431 B2 9/2015 Bain
9,179,727 B2 11/2015 Grant
9,194,136 B2 11/2015 Cormier
9,210,961 B2 12/2015 Torres
9,249,853 B2 2/2016 Cormier
9,277,781 B2 3/2016 Hardy
9,314,060 B2 4/2016 Giles
9,314,062 B2 4/2016 Marz
9,320,311 B2 4/2016 Szalkowski
9,332,800 B2 5/2016 Brown
9,380,823 B2 7/2016 Johnson
9,388,873 B1 7/2016 Phipps
9,408,423 B2 8/2016 Guerra
9,420,843 B2 8/2016 Cormier
9,440,413 B2 9/2016 Lewis
9,462,840 B2 10/2016 Leon
9,462,842 B2 10/2016 Hoshizaki
9,474,316 B2 10/2016 Berry
9,493,643 B2 11/2016 Li
9,498,014 B2 11/2016 Wingo
9,516,910 B2 12/2016 Szalkowski

(56) References Cited

U.S. PATENT DOCUMENTS 9,545,125 B2 1/2017 Yoon
9,545,127 B1 1/2017 Sandifer
9,554,611 B2 1/2017 Arrouart
9,566,497 B2 2/2017 Erb
9,572,390 B1 2/2017 Simpson
9,572,391 B2 2/2017 Mcinnis
9,578,917 B2 * 2/2017 Cohen ..... A42B 3/063
9,622,534 B2 4/2017 Cormier
9,642,410 B2 5/2017 Grice
9,656,148 B2 5/2017 Bologna
9,713,355 B2 7/2017 Daoust
9,726,249 B2 8/2017 Horstemeyer
9,750,296 B2 9/2017 Knight
9,763,487 B1 9/2017 Brown, Jr.
9,763,488 B2 9/2017 Bologna
9,770,060 B2 9/2017 Infusino
9,788,589 B2 10/2017 Lewis
9,795,180 B2 10/2017 Lowe
9,801,424 B2 10/2017 Mazzarolo
9,833,033 B2 12/2017 Erb
9,839,251 B2 12/2017 Pannikottu
9,841,075 B2 12/2017 Russo
9,968,154 B2 5/2018 Tenenbaum
10,010,126 B1 * 7/2018 Shaffer ..... A42B 3/064
10,029,633 B2 7/2018 Phipps
10,039,338 B2 8/2018 Kelly
10,085,508 B2 10/2018 Surabhi
10,105,584 B1 10/2018 Whitcomb
10,130,133 B2 11/2018 Leon
10,130,134 B2 11/2018 Blair
10,136,691 B2 11/2018 Degolier
10,136,692 B2 11/2018 Ide
10,143,255 B2 12/2018 Golnaraghi
10,149,511 B2 12/2018 Vito
10,159,296 B2 12/2018 Pietrzak
10,165,818 B2 1/2019 Suddaby
10,178,889 B2 1/2019 Wacter
10,183,423 B2 1/2019 Nauman
10,362,829 B2 * 7/2019 Lowe ..... A42B 3/128
11,291,263 B2 * 4/2022 Lowe ..... A42B 3/128
2001/0007716 A1 7/2001 Cutler
2001/0032351 A1 * 10/2001 Nakayama ..... A42B 3/064
2/412
2001/0034895 A1 11/2001 Ikeda
2002/0104533 A1 8/2002 Kalhok
2002/0114859 A1 8/2002 Cutler
2002/0166157 A1 11/2002 Pope
2002/0174480 A1 11/2002 Lombard
2003/0140400 A1 * 7/2003 Ho ..... A42B 3/063
2/412
2003/0188375 A1 10/2003 Wilson
2003/0209241 A1 11/2003 Fournier
2004/0025229 A1 * 2/2004 Takahashi ..... A42B 3/128
2/412
2004/0025231 A1 2/2004 Ide
2004/0117896 A1 6/2004 Madey
2004/0139531 A1 7/2004 Moore
2004/0250340 A1 * 12/2004 Piper ..... A42B 3/064
2/412
2004/0255364 A1 12/2004 Feher
2004/0261157 A1 12/2004 Talluri
2005/0050617 A1 3/2005 Moore
2005/0241048 A1 11/2005 Cattaneo
2005/0278834 A1 12/2005 Lee
2006/0031978 A1 2/2006 Pierce
2006/0038694 A1 2/2006 Naunheim
2006/0059605 A1 3/2006 Ferrara
2006/0059606 A1 * 3/2006 Ferrara ..... A01N 25/18
2/412
2006/0070170 A1 4/2006 Copeland
2006/0112477 A1 6/2006 Schneider
2006/0143807 A1 7/2006 Udelhofen
2006/0179537 A1 8/2006 Dennis
2006/0242752 A1 11/2006 Talluri
2007/0000032 A1 * 1/2007 Morgan ..... A42B 3/124
2/412
2007/0011797 A1 1/2007 Ikeda
2007/0094769 A1 5/2007 Lakes
2007/0151003 A1 7/2007 Shih
2007/0157370 A1 7/2007 Joubert Des Ouches
2007/0192944 A1 8/2007 Nelson
2008/0052808 A1 3/2008 Leick
2008/0086916 A1 4/2008 Ellis
2008/0155734 A1 7/2008 Yen
2008/0163410 A1 7/2008 Udelhofen
2008/0172774 A1 7/2008 Ytterborn
2008/0250550 A1 10/2008 Bologna
2008/0256686 A1 10/2008 Ferrara
2009/0031479 A1 2/2009 Rush, III
2009/0038055 A1 2/2009 Ferrara
2009/0044316 A1 2/2009 Udelhofen
2009/0183301 A1 7/2009 Brown
2009/0222964 A1 9/2009 Wiles
2009/0255036 A1 10/2009 Lim
2009/0260133 A1 10/2009 Del Rosario
2009/0265839 A1 * 10/2009 Young ..... A41D 13/015
2/413
2009/0265841 A1 10/2009 Ferrara
2010/0000009 A1 1/2010 Morgan
2010/0005573 A1 1/2010 Rudd
2010/0043127 A1 2/2010 Wang
2010/0180362 A1 7/2010 Glogowski
2010/0258988 A1 10/2010 Darnell
2010/0287687 A1 11/2010 Ho
2010/0299813 A1 12/2010 Morgan
2010/0319110 A1 * 12/2010 Preston-Powers ... A42B 3/0406
2/422
2011/0047680 A1 3/2011 Hoying
2011/0107503 A1 5/2011 Morgan
2011/0131695 A1 6/2011 Maddux
2011/0167541 A1 7/2011 Chilson
2011/0167542 A1 7/2011 Bayne
2011/0203038 A1 8/2011 Jones
2011/0209272 A1 9/2011 Drake
2011/0215931 A1 9/2011 Callsen
2011/0225706 A1 9/2011 Pye
2011/0229685 A1 9/2011 Lin
2011/0271428 A1 11/2011 Withnall
2012/0005810 A1 1/2012 Cheng
2012/0011639 A1 1/2012 Beauchamp
2012/0036619 A1 2/2012 Ytterborn
2012/0047635 A1 * 3/2012 Finiel ..... A42B 3/125
2/414
2012/0060251 A1 * 3/2012 Schimpf ..... A42B 3/064
2/5
2012/0079646 A1 4/2012 Belanger
2012/0096631 A1 4/2012 King
2012/0151663 A1 6/2012 Rumbaugh
2012/0174294 A1 7/2012 Sackett
2012/0180199 A1 7/2012 Chilson
2012/0198604 A1 * 8/2012 Weber ..... A42B 3/125
2/410
2012/0204327 A1 8/2012 Faden
2012/0210498 A1 8/2012 Mack
2012/0233745 A1 9/2012 Veazie
2012/0291183 A1 11/2012 Janisse
2012/0317704 A1 12/2012 Coyle
2012/0317705 A1 12/2012 Lindsay
2013/0000015 A1 * 1/2013 Marzec ..... A42B 3/12
2/411
2013/0000017 A1 1/2013 Szalkowski
2013/0000018 A1 1/2013 Rudd
2013/0007950 A1 1/2013 Arai
2013/0025032 A1 1/2013 Durocher
2013/0040524 A1 2/2013 Halldin
2013/0042396 A1 2/2013 Wehtje
2013/0061371 A1 3/2013 Phipps
2013/0061375 A1 3/2013 Bologna
2013/0122256 A1 5/2013 Kleiven
2013/0180034 A1 7/2013 Preisler
2013/0232668 A1 9/2013 Suddaby
2013/0283503 A1 10/2013 Zilverberg
2013/0298316 A1 11/2013 Jacob

(56) References Cited

U.S. PATENT DOCUMENTS

| | | | | |
|---|---|---|---|---|
| 2013/0340146 | A1* | 12/2013 | Dekker | A42B 3/12 2/411 |
| 2014/0000012 | A1 | 1/2014 | Mustapha | |
| 2014/0007324 | A1 | 1/2014 | Svehaug | |
| 2014/0013492 | A1 | 1/2014 | Bottlang | |
| 2014/0020158 | A1 | 1/2014 | Parsons | |
| 2014/0033402 | A1 | 2/2014 | Donnadieu | |
| 2014/0090155 | A1 | 4/2014 | Johnston | |
| 2014/0196198 | A1 | 7/2014 | Cohen | |
| 2014/0201889 | A1 | 7/2014 | Pietrzak | |
| 2014/0208486 | A1 | 7/2014 | Krueger | |
| 2014/0259309 | A1 | 9/2014 | Pettersen | |
| 2014/0338104 | A1 | 11/2014 | Vito | |
| 2014/0366252 | A1 | 12/2014 | Mazzarolo | |
| 2014/0373257 | A1* | 12/2014 | Turner | A42B 1/0183 2/414 |
| 2015/0074875 | A1 | 3/2015 | Schimpf | |
| 2015/0089725 | A1 | 4/2015 | Lowe | |
| 2015/0107005 | A1 | 4/2015 | Schneider | |
| 2015/0121609 | A1 | 5/2015 | Cote | |
| 2015/0157083 | A1 | 6/2015 | Lowe | |
| 2015/0223546 | A1* | 8/2015 | Cohen | A42B 3/127 2/412 |
| 2015/0264991 | A1 | 9/2015 | Frey | |
| 2015/0305427 | A1* | 10/2015 | Prabhu | A42B 3/061 2/412 |
| 2016/0051013 | A1 | 2/2016 | Mitchell, Jr. | |
| 2016/0053843 | A1 | 2/2016 | Subhash | |
| 2016/0058092 | A1 | 3/2016 | Aldino | |
| 2016/0073723 | A1 | 3/2016 | Halldin | |
| 2016/0088884 | A1 | 3/2016 | Guerra | |
| 2016/0113346 | A1 | 4/2016 | Lowe | |
| 2016/0255900 | A1 | 9/2016 | Browd | |
| 2017/0065018 | A1 | 3/2017 | Lindsay | |
| 2017/0105470 | A1 | 4/2017 | Eaton | |
| 2017/0164678 | A1 | 6/2017 | Allen | |
| 2017/0188649 | A1 | 7/2017 | Allen | |
| 2017/0196294 | A1 | 7/2017 | Fischer | |
| 2018/0343952 | A1 | 12/2018 | Lachance | |
| 2019/0174859 | A1 | 6/2019 | Schmidt | |
| 2019/0223536 | A1 | 7/2019 | Erb | |

FOREIGN PATENT DOCUMENTS

| | | | |
|---|---|---|---|
| CN | 102972901 | | 3/2013 |
| DE | 8321097 | | 10/1983 |
| DE | 3338188 | | 5/1985 |
| DE | 3603234 | | 8/1987 |
| DE | 3632525 | | 8/1996 |
| DE | 19745960 | | 10/1997 |
| EP | 0512193 | | 11/1992 |
| EP | 571065 | | 11/1993 |
| EP | 623292 | | 11/1994 |
| EP | 630589 | | 12/1994 |
| EP | 770338 | | 5/1997 |
| EP | 1219189 | A1 | 7/2002 |
| EP | 1388300 | | 2/2004 |
| EP | 1538935 | A1 | 6/2005 |
| EP | 1627575 | A1 | 2/2006 |
| EP | 1708587 | A1 | 10/2006 |
| EP | 1836913 | A2 | 9/2007 |
| EP | 2042048 | A2 | 4/2009 |
| EP | 2071969 | A2 | 6/2009 |
| EP | 2103229 | A2 | 9/2009 |
| EP | 2156761 | A2 | 2/2010 |
| EP | 2289360 | A2 | 3/2011 |
| EP | 2389822 | A | 11/2011 |
| EP | 2428129 | A2 | 3/2012 |
| GB | 256430 | | 8/1926 |
| GB | 1354719 | | 6/1974 |
| GB | 2481855 | A | 1/2012 |
| JP | S57205511 | | 12/1982 |
| JP | H05132809 | | 5/1993 |
| JP | 0572922 | | 10/1993 |
| JP | H07109609 | | 4/1995 |
| JP | H07126908 | | 5/1995 |
| JP | H10195707 | | 7/1998 |
| JP | 2001020121 | | 1/2001 |
| RU | 2150874 | | 6/2000 |
| WO | 9534229 | | 12/1995 |
| WO | 1998023174 | | 6/1998 |
| WO | 1999042012 | | 8/1999 |
| WO | 2000067998 | | 11/2000 |
| WO | 0152676 | | 7/2001 |
| WO | 2002028211 | | 4/2002 |
| WO | 2004023913 | | 3/2004 |
| WO | 2004052133 | | 6/2004 |
| WO | 2005000059 | | 1/2005 |
| WO | 2007047923 | | 4/2007 |
| WO | 2008085108 | A1 | 7/2008 |
| WO | 2010001230 | | 1/2010 |
| WO | 2011084660 | | 7/2011 |
| WO | 2011087435 | A1 | 7/2011 |
| WO | 2011148146 | | 12/2011 |
| WO | 2012047696 | | 4/2012 |
| WO | 2012074400 | | 6/2012 |
| WO | 2012099633 | | 7/2012 |
| WO | 2013033078 | A1 | 3/2013 |

OTHER PUBLICATIONS

Declaration of Michael W. Irvin dated Aug. 30, 2012.

Schutt Sports, 2002 Football Catalog (Exhibit 2 of Irvin Declaration).

Supplemental Declaration of Michael W. Irvin Under 37 CFR 1.132 and MPEP 2616 dated Dec. 27, 2012.

Expert Report of Mr. Rovani filed Dec. 15, 2009, *Riddell, Inc.* v. *Schutt Sports, Inc.*; U.S. District Court for the W.D. of Wisconsin; 08-cv-711.

Schutt's Response to Riddell's First Set of Interrogatories; including patent invalidity contentions and exhibit with invalidity claim charts; dated Mar. 13, 2009.

Schutt's Answer and Affirmative Defenses; *Riddell, Inc.* v. *Schutt Sports, Inc.*; U.S. District Court for the W.D. of Wisconsin; 08-cv-711; dated Feb. 16, 2009.

Plaintiff Riddell's Brief in Support of Proposed Claim Constructions; dated Apr. 29, 2009.

Plaintiff Riddell's Opinion Brief to Defendant Schutt's Proposed Claim Constructions; dated May 18, 2009.

Defendant Schutt's First Supplemental Responses to Plaintiff Riddell's First Set of Interrogatories.

Declaration of co-inventor Thad M. Ide, dated Oct. 28, 2004, 2 pages, with photographs of seven (7) helmets bearing labels A1-A6, B1-B5, C1-7, D1-D5, E1-E5, F1-F5, G1-G5, 22 pages, (commercially available prior to Apr. 29, 2003) see p. 2 of declaration.

Newman, James, "A New Biochemical Assessment of Mild Traumatic Brain Injury Part 2—Results and Communications", published prior to (critical date) Sep. 8, 2005 (Abstract only).

Newman, James, "A New Biochemical Assessment of Mild Traumatic Brain Injury Part 1—Methodology", published prior to (critical date) Sep. 8, 2005 (Abstract only).

Claim Construction Opinion and Order; *Riddell, Inc.* v. *Schutt Sports, Inc.*; U.S. District Court for the W.D. of Wisconsin; 08-cv-711; dated Jul. 10, 2009.

Schutt Photographs (Published Apr. 2001) (Exhibit 1 of Irvin Declaration).

Newman, James A., "A Proposed New Biochemical Head Injury Assessment Function—The Maximum Power Index", Stapp Paper No. OOS-80, 44th Stapp Car Crash Conference Proceedings—Copyright 2000 The Staff Association; published prior to (critical date) Sep. 8, 2005 (Abstract only).

Face-Off Lacrosse Yearbook 2003, Spring 2003, vol. 10 (3 pages).

Four Photographs of Riddell, Inc.'s VSR4 football helmet which was commercially available prior to May 1, 2001 (4 pages).

European Extended Search Report issued in EP Application No. 14868227.1 dated May 16, 2017 (8 pages).

International Search Report from PCT/US2015/057894 dated Mar. 10, 2016 (2 pages).

(56) References Cited

OTHER PUBLICATIONS

Written Opinion of the International Search Authority from PCT/US2015/057894 dated Mar. 10, 2016 (3 pages).

* cited by examiner

-- Prior Art --

MULTI-LAYER HELMET AND METHOD FOR MAKING THE SAME

CROSS-REFERENCE TO RELATED APPLICATIONS

This application is a continuation of U.S. patent application Ser. No. 16/525,263, which is a continuation of U.S. Pat. No. 10,362,829, which claims the benefit of Provisional Application No. 61/913,222, all of which are incorporated in their entirety herein by reference and made a part hereof.

TECHNICAL FIELD

Aspects of this document relate generally to helmets including multi-layer designs for improved energy management and methods for making the same. Helmets can be used in any application where providing protection to a user's head is desirable, such as, for example, use in motor sports, cycling, football, hockey, or climbing.

BACKGROUND OF THE INVENTION

FIG. 1 illustrates a cross-sectional side view of a conventional helmet 10 that comprises an outer shell 12 and a single layer of energy-absorbing material 14. The helmet 10 can be an in-molded helmet for cycling and a hard shell helmet for powersports. The single layer of energy-absorbing material 14 is formed of a relatively rigid single or dual density monolithic material 16, such as expanded polystyrene (EPS). The monolithic rigid design of helmet 10 provides energy dissipation upon impact through deformation of the single layer of energy-absorbing material 14, which does not allow for flex or movement of the helmet 10. A contour of an inner surface 18 of the helmet 10 comprises a generic or standardized surface of a fixed proportion, such as a smooth and symmetrical topography that does not closely align or conform to the proportions and contours of a head 20 of the person wearing the helmet 10. Because heads include different proportions, smoothness, and degrees of symmetry, any given head 20 will include differences from the inner surface 18 of a conventional helmet 10, which can result in pressure points and a gap or gaps 22 between inner surface 18 of helmet 10 and the wearer's head 20. Due to the gaps 22, the wearer may experience shifting and movement of the helmet 10 relative to his head 20, and additional padding or a comfort material might be added between the inner surface 18 of the helmet 10 and the users head 20 to fill the gap 22, and reduce movement and vibration.

SUMMARY

In one aspect, a protective helmet can comprise an outer shell, and a multi-layer liner disposed within the outer shell and sized for receiving a wearer's head. The multi-layer liner can comprise an inner-layer comprising an inner surface oriented towards an inner area of a helmet for a wearer's head, wherein the inner-layer comprises a mid-energy management material with a density in a range of 40-70 g/L. The multi-layer liner can also comprise a middle-layer disposed adjacent an outer surface of the inner-layer, wherein the middle-layer comprises a low-energy management material with a density in a range of 10-20 g/L. The multi-layer liner can also comprise an outer-layer disposed adjacent an outer surface of the middle-layer, the outer-layer comprising an outer surface oriented towards the outer shell, wherein the outer-layer comprises a high-energy management material with a density in a range of 20-50 g/L.

For particular implementations, the middle-layer can comprise a thickness in a range of 5-7 millimeters (mm) and be coupled to the inner-layer and the outer-layer without adhesive to facilitate relative movement among the inner-layer, the middle-layer, and the outer-layer. A total thickness of the multi-layer liner can be less than or equal to 48 mm. The protective helmet can comprise a powersports helmet, and the outer shell can comprise a rigid layer of Acrylonitrile Butadiene Styrene (ABS). The protective helmet can comprise a cycling helmet, and the outer shell can comprise a stamped, thermoformed, or injection molded polycarbonate shell. At least a portion of the multi-layer liner can be a flexible liner segmented to provide spaces or gaps between portions of the multi-layer liner. The multi-layer liner can further comprise a top portion configured to be aligned over a top of the wearer's head, and the top portion of the multi-layer liner can be formed without the middle-layer disposed between the inner-layer and the outer-layer.

In one aspect, a protective helmet can comprise a multi-layer liner comprising a thickness less than or equal to 48 mm. The multi-layer liner can comprise an inner-layer comprising an inner surface oriented towards an inner area of a helmet for a wearer's head, wherein the inner-layer comprises a mid-energy management material. The multi-layer liner can comprise a middle-layer disposed adjacent an outer surface of the inner-layer, wherein the middle-layer comprises a low-energy management material comprising a thickness in a range of 5-7 mm. The multi-layer liner can comprise an outer-layer disposed adjacent an outer surface of the middle-layer, wherein the outer-layer comprises a high-energy management material.

For particular implementations, the low-energy management material comprises a density in a range of 10-20 g/L, and the high-energy management material can comprise a density in a range of 20-50 g/L. The multi-layer liner can provide boundary conditions at interfaces between layers of the multi-layer liner to deflect energy and manage energy dissipation for low-energy, mid-energy, and high-energy impacts. A topography of the inner liner layer can be custom fitted to match a topography of the wearer's head so that a gap between the wearer's head and the multi-layer liner of the helmet is reduced or eliminated. The mid-energy management material can comprise EPS or expanded polyolefin (EPO) with a density of 20-40 g/L, or expanded polypropylene (EPP) with a density of 30-50 g/L. The middle-layer can be mechanically coupled to the inner-layer and the outer-layer to allow for relative movement among the middle-layer, inner-layer, and outer-layer. At least a portion of the multi-layer liner can comprise a segmented flexible liner comprising spaces or gaps between portions of the multi-layer liner.

In one aspect, a protective helmet can comprise a multi-layer liner comprising a high-energy management material comprising a density in a range of 20-50 g/L, a mid-energy management material comprising a density in a range of 40-70 g/L, and a low-energy management material comprising a density in a range of 10-20 g/L.

For particular implementations, the high-energy management material can comprise EPS that is formed as an outer layer of the multi-layer liner. The mid-energy management material can comprise EPP that is formed as a middle-layer of the multi-layer liner. The low-energy management material can comprise EPO that is formed as a inner-layer of the multi-layer liner. A mid-energy management material can be selected from the group consisting of polyester, polyurethane, D3O® (i.e., non-Newtonian shear thickening polymeric), poron, an air bladder, and h3lium. At least one padding snap can be coupled to the multi-layer liner to facilitate relative movement between the high-energy management material, the low-energy management material, and the a mid-energy management material. The protective helmet can comprise a powersports helmet further comprising a rigid outer shell. The protective helmet comprises a cycling helmet further comprising an outer shell formed of a stamped, thermoformed, or injection molded polycarbonate shell.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

The invention will hereinafter be described in conjunction with the appended drawings, where like designations denote like elements, and.

DETAILED DESCRIPTION

Figure 1:
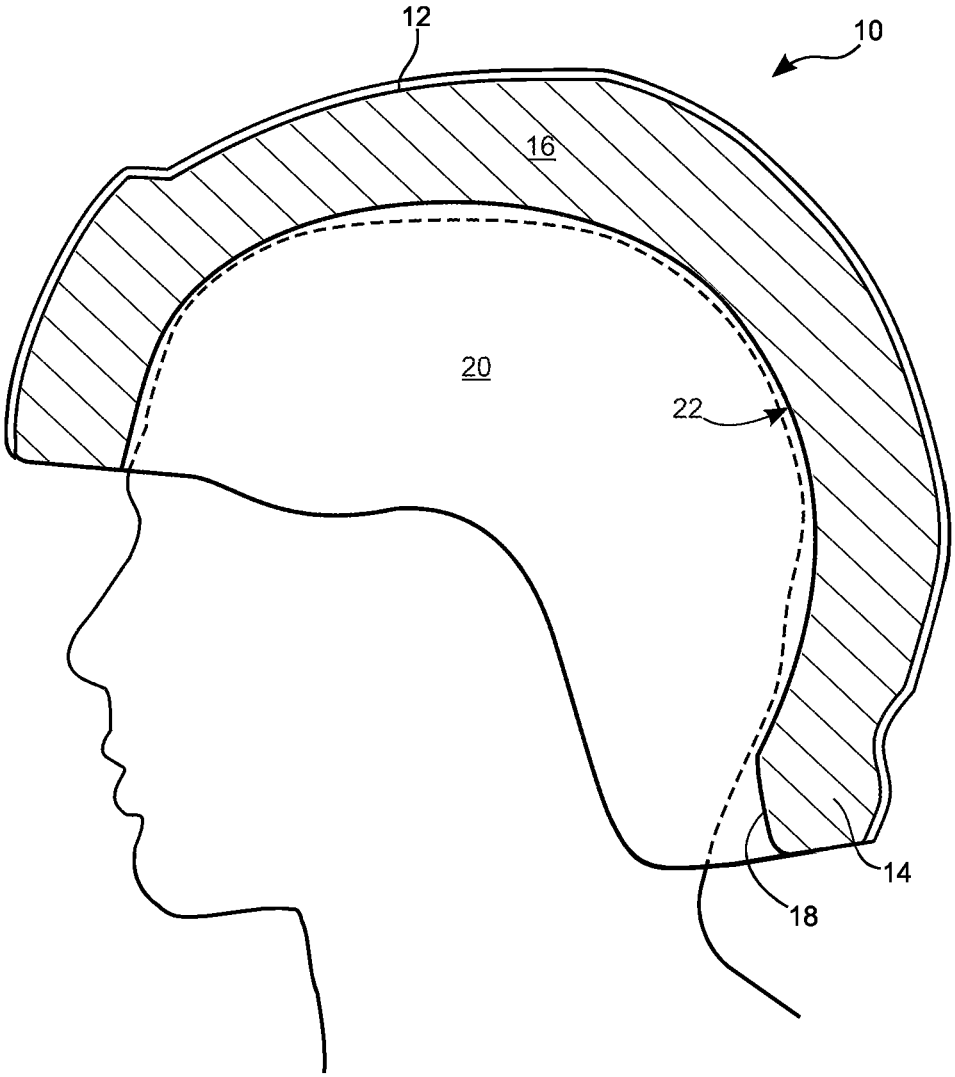
FIG. 1 is a cross-sectional view of a conventional helmet.

This disclosure, its aspects and implementations, are not limited to the specific helmet or material types, or other system component examples, or methods disclosed herein. Many additional components, manufacturing and assembly procedures known in the art consistent with helmet manufacture are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof, are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes of embodiments in many different forms, there is shown in the drawings and will herein be described in detail particular embodiments with the understanding that the present disclosure is to be considered as an exemplification of the principles of the disclosed methods and systems, and is not intended to limit the broad aspect of the disclosed concepts to the embodiments illustrated.

This disclosure provides a system and method for custom forming protective helmet for a wearer's head, such as a helmet for a cyclist, football player, hockey player, baseball player, lacrosse player, polo player, climber, auto racer, motorcycle rider, motocross racer, skier, snowboarder or other snow or water athlete, sky diver or any other athlete in a sport or other person who is in need of protective head gear. Each of these sports uses a helmet that includes either single or multi-impact rated protective material base that is typically, though not always, covered on the outside by a decorative cover and includes comfort material on at least portions of the inside, usually in the form of padding. Other industries also use protective headwear, such as a construction, soldier, fire fighter, pilot, or other worker in need of a safety helmet, where similar technologies and methods may also be applied.

Figure 2A:
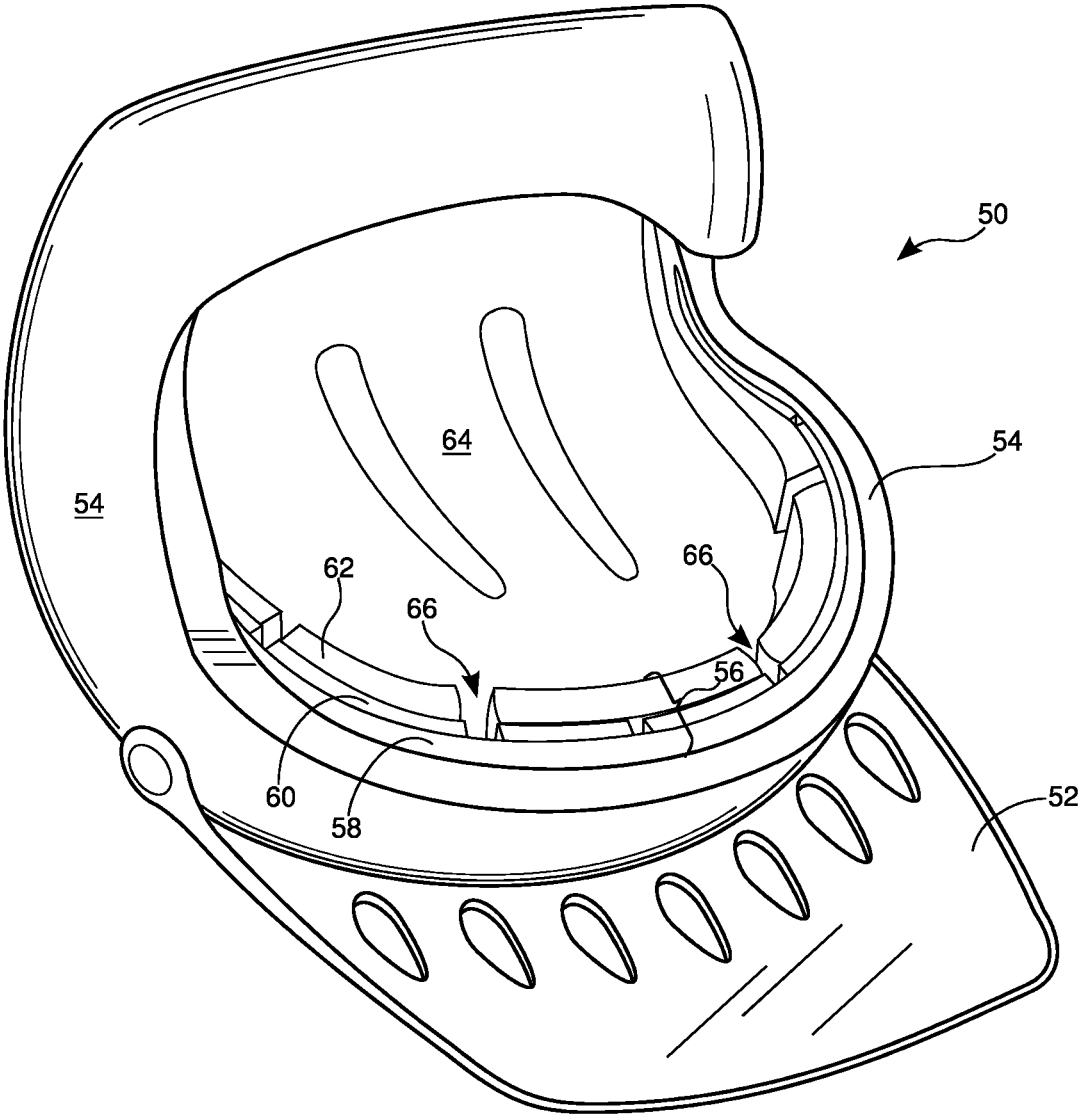
FIGS. 2A-2E show various views of a multi-layer helmet.

FIG. 2A shows a perspective view of a helmet or multi-layer helmet 50. Multi-layer helmet 50 can be designed and used for cycling, power sports or motor sports, and for other applications to provide added comfort, functionality, and improved energy absorption with respect to the conventional helmets known in the prior art, such as helmet 10 shown in FIG. 1. As shown in FIG. 2A, helmet 50 can be configured as a full-face helmet, and is shown oriented top down with a visor 52 positioned at a lower edge of FIG. 2A. The helmet 50 comprises an outer shell 54 and a multi-layer liner 56.

Outer shell 54 can comprise a flexible, semi-flexible, or rigid material, and can comprise plastics, including ABS, polycarbonate, Kevlar, fiber materials including fiberglass or carbon fiber, or other suitable material. The outer shell 54 can be formed by stamping, thermoforming, injection molding, or other suitable process. While the outer shell 54 is, for convenience, referred to throughout this disclosure as an outer shell, "outer" is used to describe a relative position of the shell with respect to the multi-layer liner 56 and a user's head when the helmet 50 is worn by the user. Additional layers, liners, covers, or shells can be additionally formed outside of the outer shell 54 because the outer shell 54 can be, but does not need to be, the outermost layer of the helmet 50. Furthermore, in some embodiments outer shell 54 can be optional, and as such can be omitted from the helmet 50, such as for some cycling helmets.

Multi-layer liner 56 can comprise two or more layers, including three layers, four layers, or any number of layers. As a non-limiting example, FIG. 2A shows the multi-layer liner 56 comprising three layers: an outer-layer 58, a middle-layer 60, and an inner-layer 62. Other additional layers, such as a comfort liner layer 64 can also be included. FIG. 2A shows an optional comfort liner layer 64 disposed inside the multi-layer liner 56 and adjacent the inner-layer 62.

The layers within the multi-layer liner 56 of the helmet 50 can each comprise different material properties to respond to different types of impacts and different types of energy management. Different helmet properties, such as density, hardness, and flexibility, can be adjusted to accommodate different types of impacts and different types of energy management. A helmet can experience different types of impacts that vary in intensity, magnitude, and duration. In some cases, a helmet can be involved in low-energy impact, while in other instances, a helmet can be involved in a high-energy impact. Impacts can include any number of other medium-energy impacts that fall within a spectrum between the low-energy impacts and the high-energy impacts.

Conventional helmets with single layer liners, such as the helmet 10 from FIG. 1, comprise a single energy management layer that is used to mitigate all types of impacts through a standardized, single, or "one-size-fits-all" approach to energy management. By forming the helmet 50 with the multi-layer liner 56, the multiple layers within the multi-layer liner 56 can be specifically tailored to mitigate particular types of impacts, as described in greater detail below. Furthermore, multiple liner layers can provide boundary conditions at the interfaces of the multiple liner layers that also serve to deflect energy and beneficially manage energy dissipation at various conditions, including low-energy impacts, mid-energy impacts, and high-energy impacts. In some embodiments, multi-layer liner 56 can be formed with one or more slots, gaps, channels, or grooves 66 that can provide or form boundary conditions at the interface between multi-layer liner 56 and the air or other material that fills or occupies the slots 66. The boundary conditions created by slots 66 can serve to deflect energy and change energy propagation through the helmet to beneficially manage energy dissipation for a variety of impact conditions.

In the following paragraphs, a non-limiting example of the multi-layer liner 56 is described with respect to the outer-layer 58, the middle-layer 60, and the inner-layer 62, as shown, for example, in FIGS. 2A-2E. While the outer-layer 58 is described below as being adapted for high-energy impacts, the middle-layer 60 is described below as being adapted for low-energy impacts, and the inner-layer 62 is described as being adapted for mid-energy impacts, in other embodiments, the ordering or positioning of the various layers could be varied. For example, the outer-layer 58 can also be adapted for low-energy as well as for mid-energy impacts. Furthermore, the middle-layer 60 can be adapted for high-energy impacts as well as for mid-energy impacts. Similarly, the inner-layer 62 can be adapted for high-energy impacts as well as for low-energy impacts. Additionally, more than one layer can be directed to a same or similar type of energy management. For example, two layers of the multi-layer liner can be adapted for a same level of energy management, such as high-energy impacts, mid-energy impacts, or low-energy impacts.

According to one possible arrangement, the outer-layer 58 can be formed as a high-energy management material and can comprise a material that is harder, more dense, or both, than the other layers within the multi-layer liner 56. A material of the outer-layer 58 can comprise EPS, EPP, Vinyl Nitrile (VN), or other suitable material. In an embodiment, the outer-layer 58 can comprise a material with a density in a range of about 30-90 grams/liter (g/L), or about 40-70 grams/liter (g/L), or about 50-60 g/L. Alternatively, the outer-layer 58 can comprise a material with a density in a range of about 20-50 g/L. By forming the outer-layer 58 with a material that is denser than the other layers, including middle-layer 60 and inner-layer 62, the denser outer-layer 58 can manages high-energy impacts while being at a distance farther from the user's head. As such, less dense or lower-energy materials will be disposed closer to the user's head and will be more yielding, compliant, and forgiving with respect to the user's head during impacts. In an embodiment, the outer-layer 58 can comprise a thickness in a range of about 5-25 mm, or about 10-20 mm, or about 15 mm, or about 10-15 mm.

The middle-layer 60 can be disposed or sandwiched between the outer-layer 58 and the inner-layer 62. The middle-layer 60, when formed as a low-energy management layer, can be formed of EPO, polyester, polyurethane, D3O® (i.e., non-Newtonian shear thickening polymeric), Poron, an air bladder, h3lium, a comfort liner material, or other suitable material. The middle-layer 60 can comprise a density in a range of about 5-30 g/L, about 10-20 g/L, or about 15 g/L. The middle-layer 60 can have a thickness less than a thickness of both the inner-layer 62 and outer-layer 58 (both separately and collectively). In an embodiment, the middle-layer 60 can comprise a thickness in a range of about 3-9 mm, or about 5-7 mm, or about 6 mm, or about 4 mm.

The inner-layer 62 can be formed as a medium-energy or mid-energy management material and can comprise a material that is softer, less dense, or both, than the material of other layers, including the outer-layer 58. For example, the inner-layer 62 can be made of an energy absorbing material such as EPS, EPP, VN, or other suitable material. In an embodiment, the inner-layer 62 can be made of EPS with a density in a range of about 20-40 g/L, about 25-35 g/L, or about 30 g/L. Alternatively, the inner-layer 62 can be made of EPP with a density of about 30-50 g/L, or about 35-45 g/L, or about 20-40 g/L, or about 40 g/L. Alternatively, the inner-layer 62 can comprise a material with a density in a range of about 20-50 g/L. Forming the inner-layer 62 comprising a density within the ranges indicated above has, as part of multi-layer liner 56, provides better performance during mid-energy impact testing than conventional helmets and helmets without a inner-layer 62 or a mid-energy liner. By forming the inner-layer 62 as being less dense than the outer-layer 58 and more dense than the middle-layer 60, the inner-layer 62 as part of the multi-layer liner 56 can advantageously manage low-energy impacts. In an embodiment, the inner-layer 62 can comprise a thickness in a range of about 5-25 mm, 10-20 mm, or about 10-15 mm.

An overall or total thickness for the multi-layer liner 56 can comprise a thickness less than or equal to 50 mm, 48 mm, 45 mm, or 40 mm. In some embodiments, an overall thickness of the multi-layer liner 56 can be determined by dividing an available amount of space between the outer shell 54 and the desired position of an inner surface of helmet 50. The division of the overall thickness of multi-layer liner 56 can be accounted for by first allocating a thickness of the middle layer 60 to have a thickness in a range indicated above, such as about 6 mm or 4 mm. Second, a thickness of the outer-layer 58 and a thickness of the inner-layer 62 can be determined based on a material type, such as EPS or EPP as indicated above, and a desired thickness that will accommodate moldability and bead flow of the selected material for formation of the respective layers. A thickness of the outer-layer 58 and the inner-layer 62 can be a same or different thickness, and can be adjusted based on a specific need of a user or a sport specific application and probable impact types that correspond to, or involve, specific energy-levels or ranges.

A desired performance of multi-layer helmet 50 can be obtained by performance of individual layers specifically adapted for specific types of energy management, such as low-energy, mid-energy, and high-energy, as well as a cumulative of synergistic effect resulting from an interaction or interrelatedness of more than one layer. In some instances, the outer-layer 58 can be configured as described above and can account for a majority, or significant portion, of the energy management in high-energy impacts. In other instances, all of the layers of the multi-layer liner 56, such as the outer-liner 58, the middle-layer 60, and the inner-layer 62, all contribute significantly to energy management in high-energy impacts. In some instances, the middle-layer 60, including the middle-layer 60 formed of EPO, can be configured as described above and can account for a majority, or significant portion, of the energy management in low-energy impacts. In some instances, the inner-layer 62, including the inner-layer 62 formed of EPP or EPS, can be configured as described above and can account for a majority, or significant portion, of the energy management in mid-energy impacts. In other instances, the middle-layer 60 and the inner-layer 62 together, including layers of EPO and EPP, respectively, can be configured as described above, to account for a majority, or significant portion, of the energy management in mid-energy impacts. Or stated differently, a combination of layers comprising EPO and EPP, or other similar materials, can account for a majority, or significant portion, of the energy management in mid-energy impacts.

In an embodiment, the outer-layer 58 of the multi-layer liner 56 can comprise a high-energy management material comprising EPS with a density in a range of 20-50 g/L. The middle-layer 60 of the multi-layer liner 56 can comprise a mid-energy management material comprising EPP with a density in a range of 40-70 g/L. The inner-layer 62 of the multi-layer liner 56 can comprise a low-energy management material comprising EPO with a density in a range of 10-20 g/L.

Figure 2B:
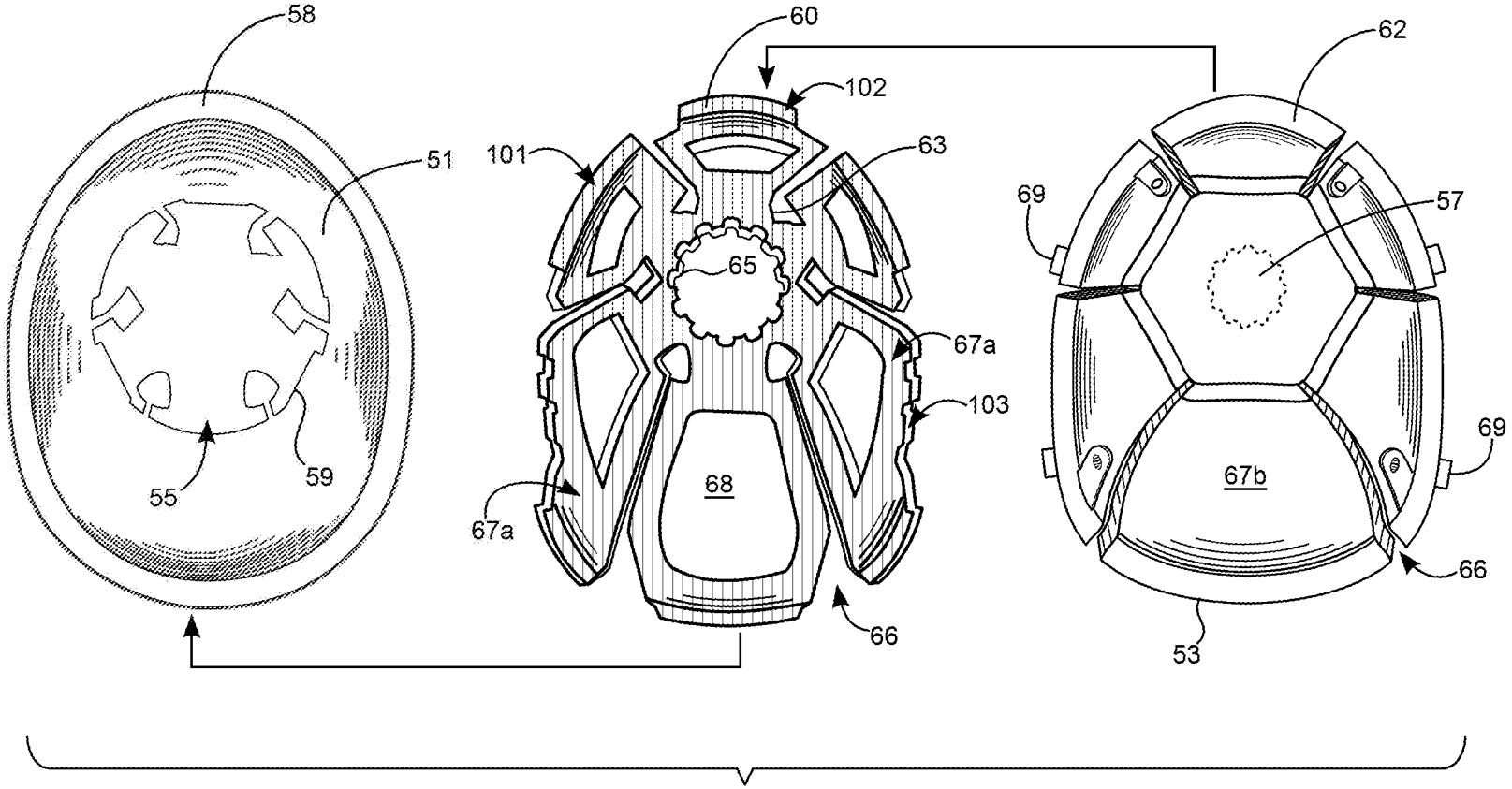

FIG. 2B provides additional detail for an embodiment of multi-layer liner 56 comprising the outer-layer 58, the middle-layer 60, and the inner-layer 62. FIG. 2B provides a perspective view from below the inner surfaces of the outer-layer 58, the middle-layer 60, and the inner-layer 62 in which the of the outer-layer 58, the middle-layer 60, and the inner-layer 62 are disposed in a side-by-side arrangement. The side-by-side arrangement of the outer-layer 58, the middle-layer 60, and the inner-layer 62 is for clarity of illustration, and does not reflect the position or arrangement of the layers within the helmet 50 that will be assumed when the helmet 50 is in operation or ready to be worn by a user. When helmet 50 is worn, or in operation, the outer-layer 58, the middle-layer 60, and the inner-layer 62 are nested one within another, as shown in FIG. 2A.

At the left of FIG. 2B, outer-layer 58 is shown comprising an inner surface 51. Outer-layer 58 can be substantially solid, as shown, or alternatively, can comprise grooves, slots, or channels extending partially or completely through the outer-layer 58, as discussed in greater detail below with respect to FIG. 4A, to provide greater flexibility to the outer-layer 58. The inner surface 51 of outer-layer 58 can comprise a first movement limiter 55, disposed at a central portion of the inner surface 51. Similarly, at the right of FIG. 2B, the inner-layer 62 is shown comprising an outer surface 53. The inner-layer 62 can be substantially solid and can additionally comprise grooves, slots, or channels 66, as previously shown in FIG. 2A, that can extend partially or completely through the outer-layer 58. Advantages of slots or channels 66 are discussed in greater detail below, with respect to slots 90 and the flex of liner 88 in FIGS. 4A-4C. The outer surface 53 of inner-layer 62 can comprise a second movement limiter 57, disposed at a central portion of the outer surface 53.

The first movement limiter 55 and second movement limiter 57 can be formed as first and second molded contours, or integral pieces, of outer-layer 58 and inner layer-62, respectively. As a non-limiting example, the first movement limiter 55 can be formed as a recess, void, detent, channel, or groove as shown in FIG. 2B. A perimeter of first movement limiter 55 can comprise a periphery or outer edge 59 that is formed with a curved, squared, straight, undulating, or gear-shape pattern comprising a series or one or more sides, projections, tabs, flanges, protuberances, extensions, or knobs. The second movement limiter 57, can, without limitation, be formed as a projection, tab, flange, protuberance, extension, or knob. Similarly, a perimeter of the second movement limiter 57 can comprise a periphery or outer edge 61 that can be formed with a curved, squared, straight, undulating, or gear-shape pattern comprising a series or one or more sides, projections, tabs, flanges, protuberances, extensions, or knobs.

The first movement limiter 55 and second movement limiter 57 can be reverse images of one another, and can be mateably arranged so as to be interlocking one with the other. As shown in FIG. 2B, first movement limiter 55 is shown as a recess extending into inner surface 51 of outer-layer 58, and second movement limiter 57 is shown as a projection, extending away from outer surface 53 of inner-layer 62. In an alternative embodiment, the recess-and-projection configuration of the first movement limiter 55 and the second movement limiter 57 can be reversed so that the first movement limiter 55 is formed as a projection and the second movement limiter 57 is formed as a recess or indent. Relative movement, whether translational, rotational, or both, between the outer-layer 58 and the inner-layer 62 can be limited by direct contact, or indirect contact, between first movement limiter 55 and second movement limiter 57. In instances where the multi-layer liner 56 comprises only the outer-layer 58 and the inner-layer 62, direct contact can be made. Alternatively, when the multi-layer liner 56 further comprises a middle-layer 60, the middle layer 60 can serve as an interface disposed between the first movement limiter 55 and the second movement limiter 57. In either event, an amount of rotation can be limited by the size, spacing, and geometry of the first movement limiter 55 and the second movement limiter 57 with respect to each other.

FIG. 2B shows an embodiment in which the middle-layer 60 is configured to be disposed between, and come in contact with, the first movement limiter 55 and the second movement limiter 57. The middle-layer 60 is shown with a first interface surface 63 and a second interface surface 65. The first interface surface 63 can be curved, squared, straight, undulating, or gear-shaped comprising a series or one or more sides, projections, tabs, flanges, protuberances, extensions, or knobs to correspond to, be a reverse images of, be mateably arranged or interlocking with, first movement limiter 55 or periphery 59. Similarly, the second interface surface 65 can be curved, squared, straight, undulating, or gear-shaped comprising a series or one or more sides, projections, tabs, flanges, protuberances, extensions, or knobs to correspond to, be a reverse images of, be mateably arranged or interlocking with, second movement limiter 57 or periphery 61. An amount of movement between the outer-layer 58 and the inner-layer 62 can also be controlled, limited, or influenced by a configuration and design of the middle-layer 60, including a hardness, springiness, or deformability of the middle-layer 60, as well as by a configuration and design of a size, spacing, and geometry of the first interface surface 63 and the second interface surface 65 with respect to the first rotation limier 55 and the second movement limiter 57, respectively. While a non-limiting example of a relationship or interaction between the first movement limiter 55 and the second movement limiter 57 have been described herein, any number or arrangement of movement limiters and layers can be arranged according to the configuration and design of multi-layer liner 56.

FIG. 2B also shows a non-limiting example in which middle-layer 60, which has a lowermost edge 101, wherein said lowermost edge has a linear extent 102 that is provisioned in the front region of the multi-layer linear 56 and a non-linear extent 103 that is positioned in a side region of the multi-layer liner 56. The middle-layer 60 also has a plurality of grooves, slots, or channels 66, that extend completely through the middle-layer 60 and align with the grooves 66 formed in inner-layer 62, as previously shown in FIG. 2A. Advantages of slots or channels 66 are discussed in greater detail below with respect to slots 90 and the flex of liner 88 in FIGS. 4A-4C, below. Slots 66 in middle-layer 60 can divide the middle layer into a plurality of panels, wings, tabs, projections, flanges, protuberances, or extensions 67*a* that can be centrally coupled or connected at a central or top portion of middle-layer 60, such as around first interface surface 63 and second interface surface 65. Panels 67*a* can be solid or hollow, and can include a plurality of openings, cut-outs, or holes 68. A number, position, size, and geometry of panels 67*a* can align with, and correspond to, a number position, size, and geometry of panels 67*b* formed by slots 66 in inner-layer 62. While FIG. 2A a non-limiting example in which a same number of panels, such as 6 panels, can be formed in the middle-layer 60 and the inner layer 62, any number of suitable panels 67*a* and 67*b*, including different numbers of panels 67*a* and 67*b* can be formed.

Different configurations and arrangements for coupling layers of multi-layer liner 56 to each other are contemplated. A way in which layers of multi-layer liner 56 are coupled together can control a relationship between impact forces and relative movement of layers within the multi-layer liner 56. Various layers of multi-layer liner 56, such as outer-layer 58, middle-layer 60, and inner-layer 62, can be coupled or directly attached to one another chemically, mechanically, or both. In some embodiments, coupling occurs only mechanically and without adhesive. The coupling of the various layers of the multi-layer liner 76 can comprise use of adhesives such as glue, or other suitable material, or with mechanical means such tabs, flanges, hook and loop fasteners, or other suitable fastening device. An amount, direction, or speed of relative movement among layers of the multi-layer liner 56 can be affected by how the layers are coupled. Advantageously, relative movement can occur in a direction, to a desired degree, or both, based on the configuration of the multi-layer liner 56. FIGS. 2B and 2D show a non-limiting embodiment in which the inner-layer 62 comprises tabs, flanges 69 formed on the outer surface 53 of inner-layer 62.

Figure 2C:
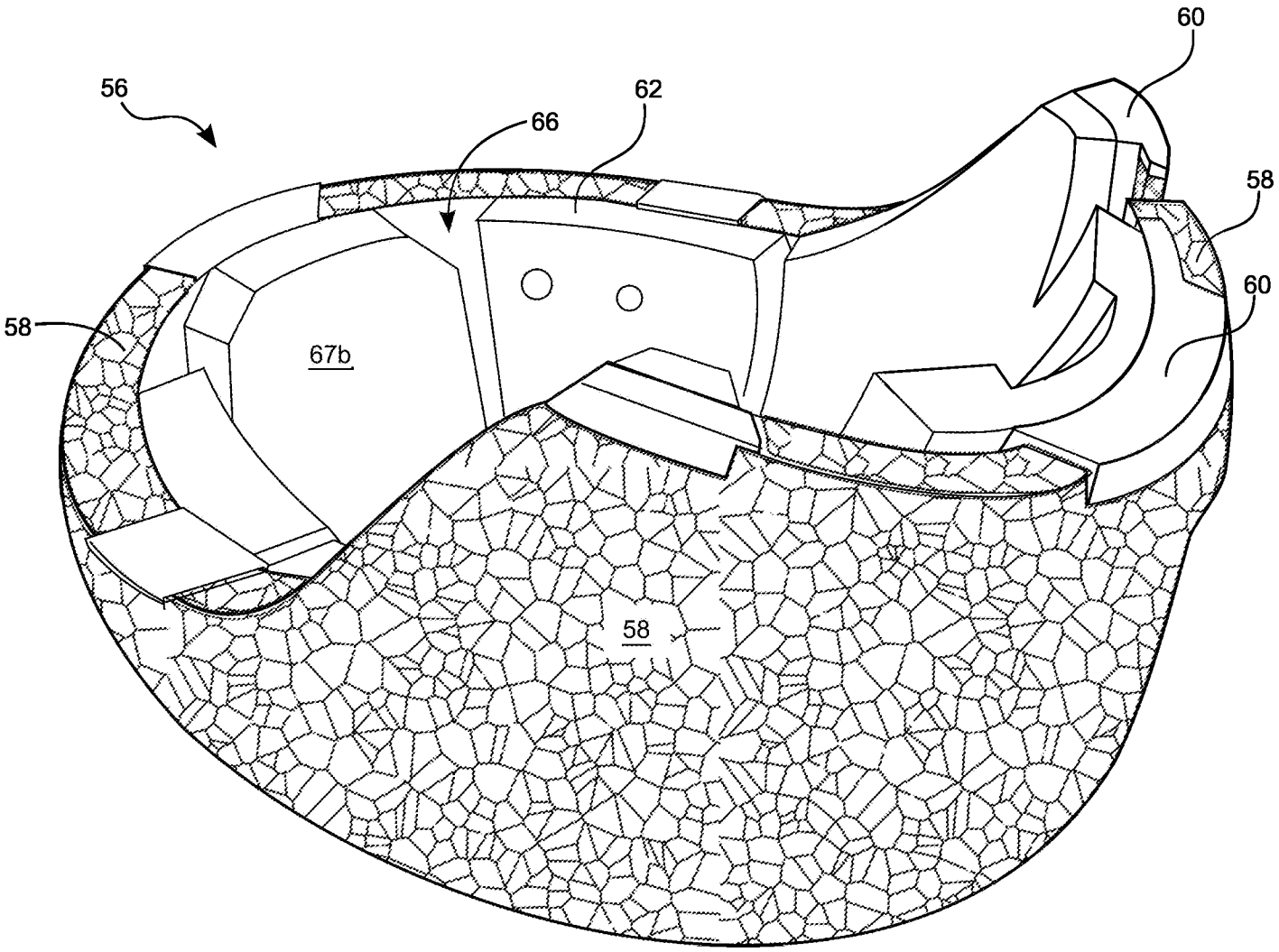
Figure 2D:
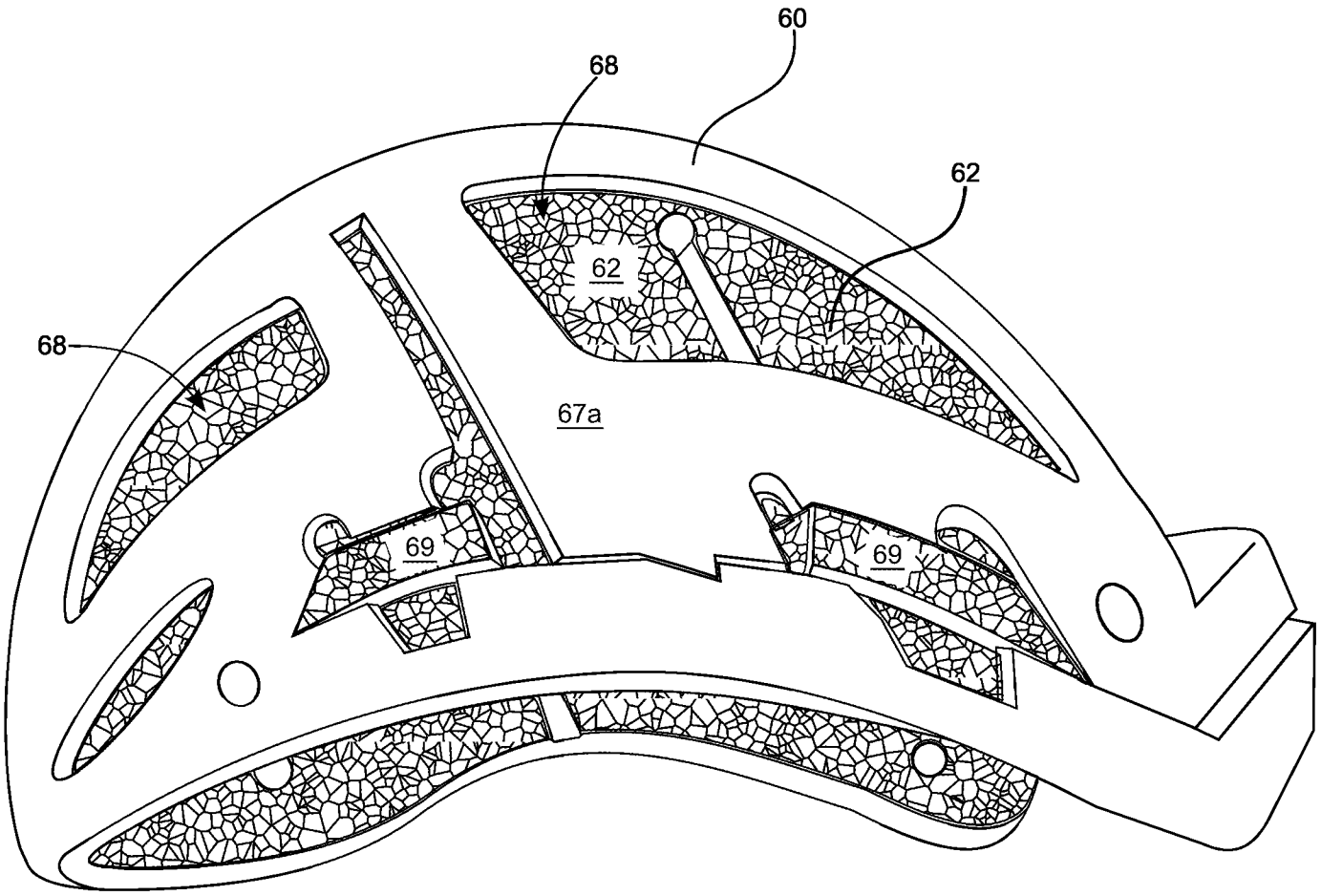

FIG. 2C shows another perspective view of the multi-layer liner 56 from FIGS. 2A and 2B. The multi-layer liner 56 is shown with the outer-layer 58, the middle-layer 60, and the inner-layer 63, nested one within each other and the opening for a user's head within the multi-layer liner 56 oriented in an upwards direction.

FIG. 2D shows another perspective view of the multi-layer liner 56 from FIGS. 2A-2C showing only the inner-layer 63 nested within the middle-layer 60 without showing the outer-layer 58. Multi-layer liner 56 is shown in a side view with tabs 69 of inner inner-layer 63 interlocking with openings in the middle-layer 60.

Figure 2E:
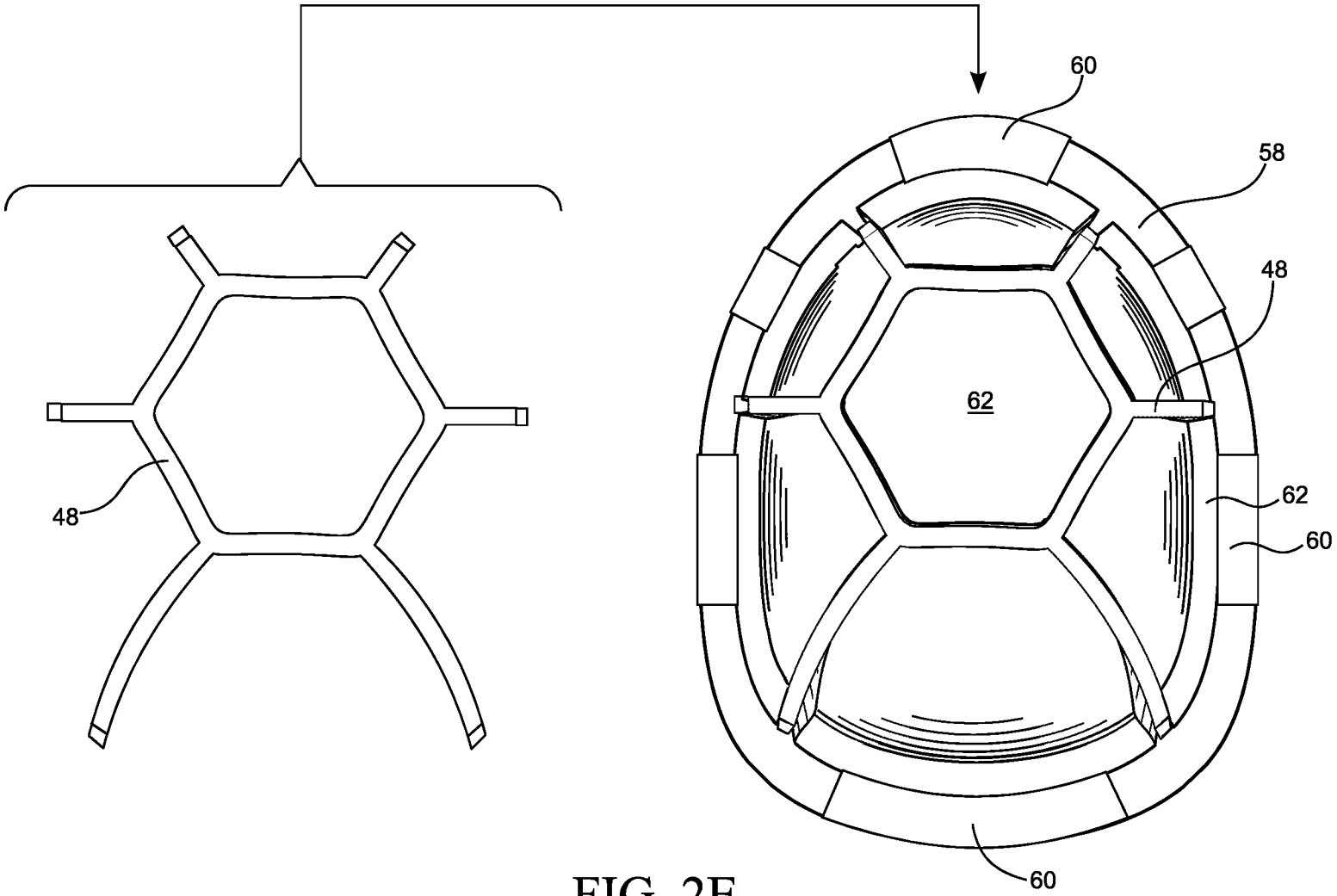

FIG. 2E shows a top perspective view of the multi-layer liner 56 from FIGS. 2A-2D. FIG. 2E shows a winter plug 48 formed of an insulating material made of plastic, foam, rubber, fiber, cloth, or other suitable natural or synthetic material can be formed in a shape that corresponds to, is a reverse images of, or can be mateably arranged or interlocking openings in one or more other layers within the multi-layer liner 56, such as within slots 66 of inner-layer 62. Winter plug 48 can reduce airflow through the helmet 50 and through the multi-layer liner 56 while also increasing insulation and warmth for a user of the helmet 50.

Figure 3:
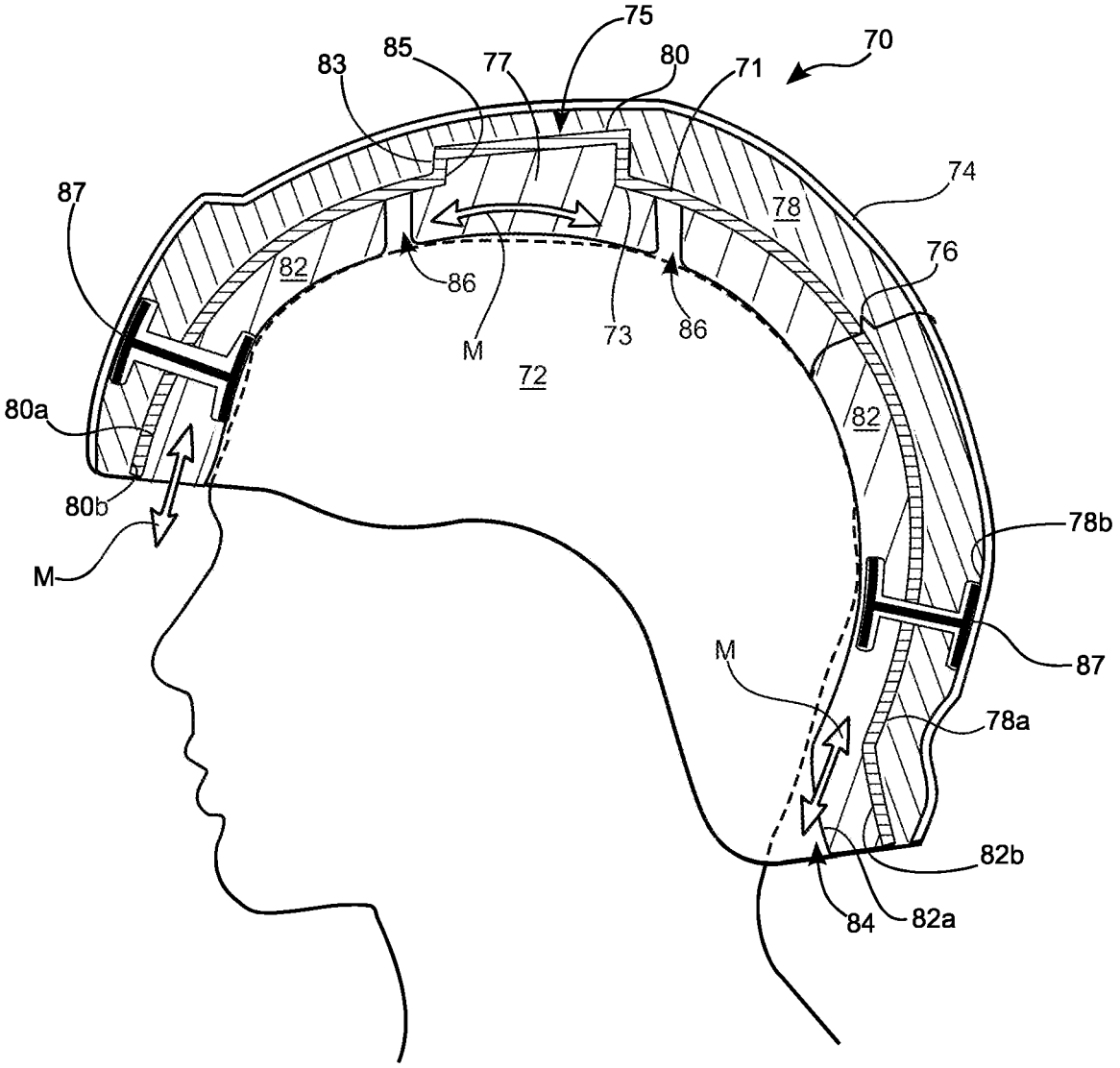
FIG. 3 is a cross-sectional view of an embodiment a multi-layer helmet.

FIG. 3 shows a cross-sectional view of a helmet or multi-layer helmet 70 similar or identical to helmet 50 shown in FIGS. 2A-2E. Multi-layer helmet 70, like multi-layer helmet 50, can be designed and used for cycling, power sports or motor sports, snow sports, water sports, and for other applications to provide added comfort, functionality, and improved energy absorption and energy management with respect to the conventional helmets known in the prior art, such as helmet 10 shown in FIG. 1. As shown in FIG. 3, helmet 70 can be configured as an in-molded or partially in-molded cycling helmet, a skate style bucket helmet, a snow helmet, or other non-full-face helmet. The helmet 70, like helmet 50, can comprise an outer shell 74 that is similar or identical to outer shell 54. Similarly, multi-layer liner 76 can be similar or identical to multi-layer liner 76. In some embodiments, outer shell 74 can be optional, such as for some cycling helmets, so that helmet 70 can be formed with the multi-layer liner 76 without the outer shell 74.

Multi-layer liner 76 can be similar or identical to multi-layer liner 56, and as such can comprise two or more layers, including three layers, four layers, or any number of layers. As a non-limiting example, FIG. 3 shows the multi-layer liner 76 comprising three layers: an outer-layer 78, a middle-layer 80, and an inner-layer 82. The outer-layer 78, the middle-layer 80, and the inner-layer 82 can be similar or identical to the outer-layer 58, the middle-layer 60, and the inner-layer 62, respectively, as described above with respect to FIGS. 2A-2E. As such, the performance and function of the multi-layer liner 76 for energy-management, including management by the layers comprised within the multi-layer liner 76, both individually, collectively, and in various combinations, can also be similar or identical to those from multi-layer liner 56 and its constituent layers.

Figure 5:
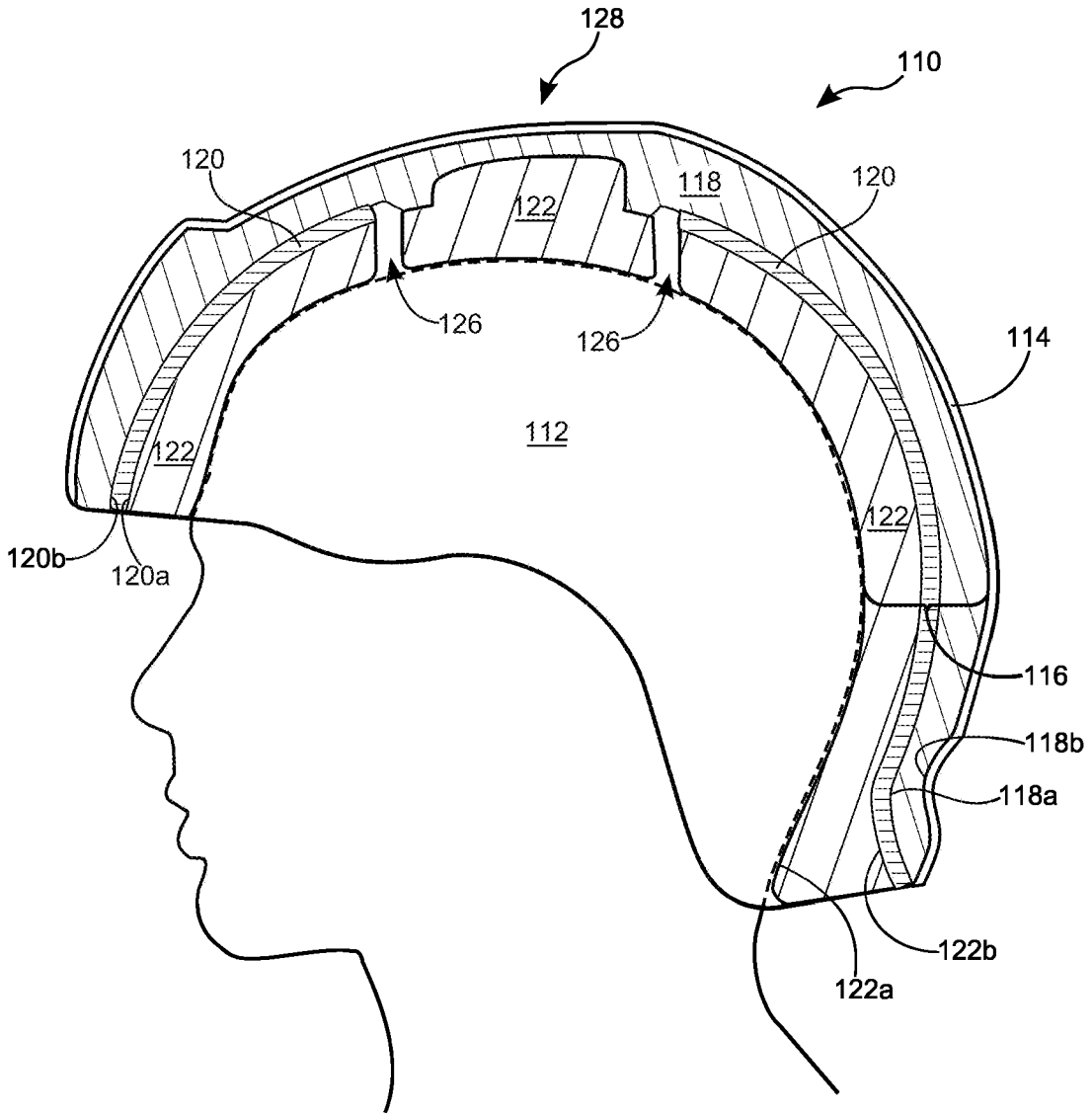
FIG. 5 is a cross-sectional view of another embodiment of a multi-layer helmet.

As shown in FIG. 3, the middle-layer 80 can be disposed between an entirety of the interface between the outer-layer 78 and the inner-layer 82. Additionally, the middle-layer 80 can be disposed between substantially an entirety of the interface between the outer-layer 78 and the inner-layer 82, such as more than 80% of the interface or more than 90% of the interface. In other embodiments, and as illustrated in FIG. 5 and described below, a middle-layer can also be disposed between a portion, or less than an entirety, of an interface between the inner and outer-layers. The layers of the multi-layer liner 76 can be coupled to each other, such as the outer-layer 78 and the inner-layer 82 both being coupled to middle-layer 80. The outer-layer 78 and the inner-layer 82 can be coupled or directly attached to opposing inner and outer side of the middle-layer 80, either chemically, mechanically, or both, using adhesives such as glue, or other suitable material, or with mechanical means such tabs, flanges, hook and loop fasteners, or other suitable fastening device.

By providing the middle-layer 80, such as a thinner middle-layer 80, between one or more layers of the multi-layer liner 76, including between outer-layer 78 and inner-layer 82, the middle-layer 80 can provide or facilitate a desirable amount of relative movement between the outer-layer 78 and the inner-layer 82 during a crash or impact while the helmet 70 is absorbing or attenuating energy of the impact. The relative movement of various layers within the multi-layer liner 76 with respect to the outer shell 74 of the helmet 70 or with respect to the user's head 72 can provide additional and beneficial energy management. An amount of relative movement, whether it be rotational, liner, or translational such as movement made laterally, horizontally, or vertically, can be varied based on how the liner layers are coupled to each other. Relative movement can occur for one or more types of energy management, including low-energy management, mid-energy management, and high-energy management.

As discussed above with respect to helmet 50 from FIGS. 2A-2E, a desired amount of relative movement among multiple layers of a multi-layer liner can also be provided, or facilitated, by movement limiters. Control of relative movement in helmet 70, as show in FIG. 3, can occur in a manner that is similar or identical to that described above with respect to the first movement limiter 55 and the second movement limiter 57 of helmet 70. Accordingly, FIG. 3 shows outer-layer 78 comprising an inner surface 71, which can further comprise a first movement limiter 75, disposed at a central portion of the inner surface 71. First movement limiter 75 can be similar or identical to the first movement limiter 55, such that the detail recited above with respect to the first movement limiter 55 is applicable to the first movement limiter 75. Similarly, the inner-layer 82 can comprise an outer surface 73 that can further comprise a second movement limiter 77, disposed at a central portion of the outer surface 73. The second movement limiter 77 can be similar or identical to the second movement limiter 57 such that the detail recited above with respect to the second movement limiter 57, and its interaction with one or more other movement limiters, is applicable to the second movement limiter 77 and helmet 70.

FIG. 3 also shows how the middle-layer 80 can be disposed between, and come in contact with, the first movement limiter 75 and the second movement limiter 77. The middle-layer 80 is shown with a first interface surface 83 and a second interface surface 85. The first interface surface 83 can be similar or identical to first interface surface 63 described above, and second interface surface 85 can be similar or identical to second interface surface 65 described above. An amount of movement between the outer-layer 78 and inner-layer 82 can also be controlled, limited, or influenced by a configuration and design of the middle-layer 80, including a surface finish level of friction, as well as by hardness, springiness, or deformability of the middle-layer 80. An amount of movement between the outer-layer 78 and inner-layer 82 can also be controlled, limited, or influenced by a configuration and design of a size, spacing, and geometry of the first interface surface 83 and the second interface surface 85 with respect to the first rotation limier 75 and the second movement limiter 77, respectively.

In addition to, and in conjunction with, using movement limiters to provide desired amount of relative movement among multiple layer of a multi-layer liner, different configurations and arrangements for coupling the liner layers to each other can also be used. Various layers of multi-layer liner 76 can be coupled, including directly attached, to each other chemically, mechanically, or both. The coupling of the various layers of the multi-layer liner 76 can comprise use of adhesives such as glue, or other suitable material, or with mechanical means such tabs, flanges, hook and loop fasteners, or other suitable fastening device. An amount, direction, or speed of relative movement among layers of the multi-layer liner 76 can be affected by how the layers are coupled. Advantageously, relative movement can occur in a direction, to a desired degree, or both, based on the configuration of the multi-layer liner 76, such as the middle-layer 80. The middle-layer 80, or another layer of the multi-layer liner 76, can also include slip planes within the multi-layer liner 76 for controlling or directing the relative movement.

In some embodiments, layers of multi-layer helmet 70 can be coupled to each other without adhesive, such as with the inner-layer 82 not being bonded with adhesive or glued to the outer-layer 78 and the middle-layer 80. One such embodiment, by way of illustration and not by limitation, is the use of one or more padding snaps 87. The padding snaps 87 can be made of rubber, plastic, textile, elastic, or other springy or elastic material. The padding snaps 87 can couple one or more layers of the multi-layer helmet 70 to each other, to the protective shell 74, or both, by at least one of the padding snaps 87 extending through an opening, hole, or cut-out in the one or more layers of the multi-layer helmet 70. In some embodiments, one or more layers of the multi-layer helmet 70 can be coupled to a desired location without the padding snaps 87 passing through an opening in that layer. The attachment device can be held at its ends the protective shell and comfort layer by or chemical attachment, such as by an adhesive, or by mechanical attachment. Mechanical attachment can include interlocking, friction, or other suitable method or device. Movement of the one or more layers of the multi-layer helmet 70 can result from a distance or length of the padding snaps 87 in-between the ends of the padding snaps 87 that allows movement, such as elastic movement.

In some instances, the padding snaps 87 can include a "T" shape, an "I" shape, a "Z" shape, or any other suitable shape that comprises a widened portion at a top, bottom, or both of the padding snap 87 further comprises a narrower central portion. The top widened portion can include a head, tab, or flange, or barbs, an underside of which contacts layers of the multi-layer helmet 70 around the opening in the layer through which the padding snap 87 can pass. Similarly, the bottom widened portion can include a head, tab, flange or barbs that contact an inner portion of the opening in the protective shell for receiving the attachment device. In any event, the padding snap 87 can couple one or more layers of the multi-layer helmet 70 in such a way as to allow a range of motion or relative movement among layers or portion of the helmet 70. The range of motion can be adjusted to a desirable layer amount or distance by adjusting a size, elasticity, or other feature of the padding snap 87. The range of motion can also be adjusted by adjusting a number and position of the padding snaps 87. In an embodiment, each panel, flex panel, or portion of a liner layer separated or segmented by one or more slots can receive, and be coupled to, a padding snap 87. In other embodiments, a fixed number of padding snaps 87 for the helmet 70, or number of padding snaps 87 per given surface area of the helmet 70 will be used, such as a total of 3, 4, 5, 6, or any suitable number of padding snaps. As such, the padding snaps 87 can allow for a desired amount of sheer force, flexibility, and relative movement among the outer-layer 78, the middle-layer 80, and the inner-layer 82 for better energy management.

As shown in FIG. 3, a gap or space 84 can exist between an inner surface of inner-layer 82 and a surface of the user's head 72. The gap 84 can extend along an entirety of the interface between user's head 72 and multi-layer liner 76, or along a portion of the interface less than the entirety. The gap 84 can exist as a result of a topography of an individual wearer's head not matching a standardized sizing scheme of helmet 70. As a result, an additional interface layer or layer of comfort padding can be added to the helmet 70 to fill or occupy the space between inner surface 82 of inner-layer 82 and the outer surface or topography of user's head 72.

As indicated above with respect to multi-layer liner 56, and as is true with multi-layer liner 76, multiple liner layers can provide boundary conditions at the interfaces of the multiple liner layers that serve to deflect energy and beneficially manage energy dissipation at various conditions, including low-energy impacts, mid-energy impacts, and high-energy impacts. In some embodiments, multi-layer liner 76 can be formed with one or more slots, gaps, channels, or grooves 86 that can provide or form boundary conditions at the interface between multi-layer liner 76 and the air or other material that fills or occupies the slots 86. The boundary conditions created by slots 86 can serve to deflect energy and change energy propagation through the helmet to beneficially manage energy dissipation for a variety of impact conditions.

Figure 4A:
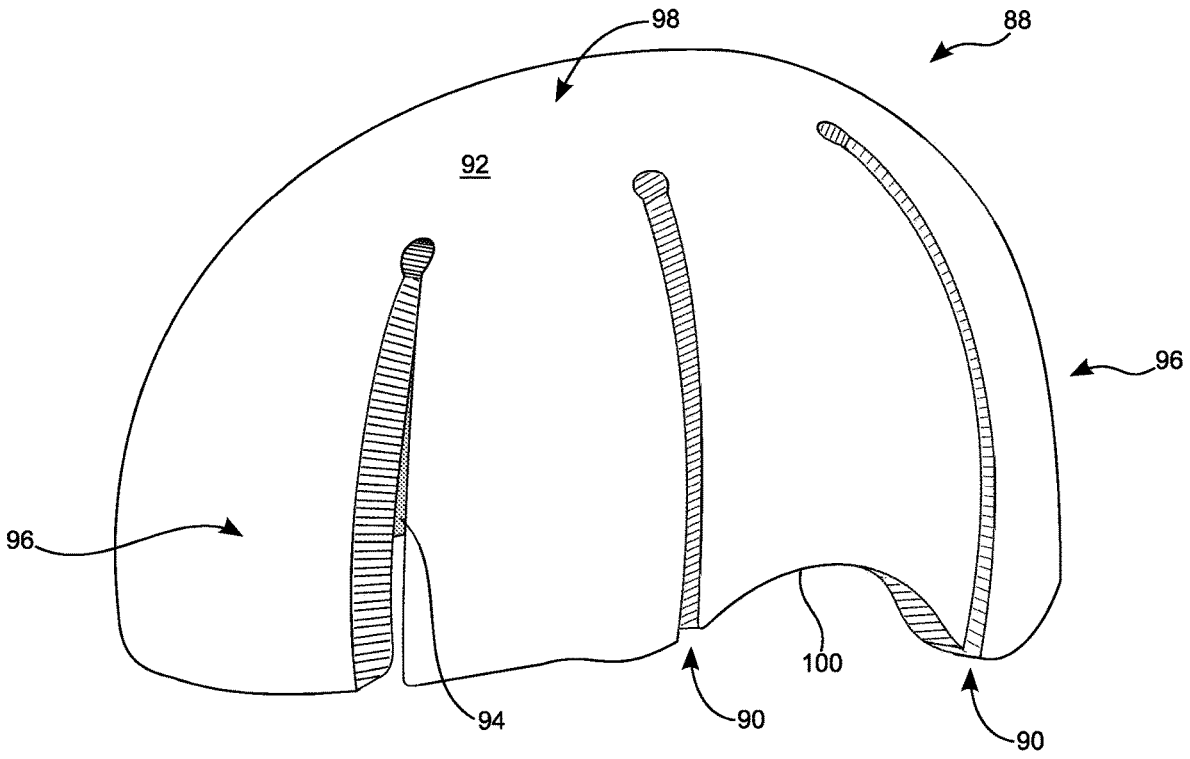
FIGS. 4A-4C show various view of a layer from a multi-layer liner.

FIG. 4A shows a perspective view of a liner layer 88 that can be part of a multi-layer liner for a flexible multi-layer helmet such as multi-layer liner 56 or multi-layer liner 76. Liner layer 88 can be formed of any of the materials, and with any of the parameters or densities described above for layers 58, 60, 62, 78, 80, or 82. The liner layer 88 can be formed as any layer within a multi-liner layer, including an outer-layer, a middle-layer or intermediate-layer, and as an inner-layer. In some embodiments, liner layer 88 will be formed as an inner-layer, such as inner layer 62 shown in FIGS. 2A-2E. As such, liner layer 88 can be formed and configured to manage any specific type of impact or types of impacts including low-energy impacts, mid-energy impacts, and high-energy impacts.

As shown in FIG. 4A, liner layer 88 can comprise a plurality of slots, gaps, channels, or grooves 90 that can be formed partially or completely through the liner layer 88. As shown in FIG. 4A, the slots 90 can extend completely through the liner layer 88, such as from an outer surface 92 of liner layer 88 to and inner surface 94 of the liner layer 88. Slots 90 can be similar or identical to slots 66 and 86 shown in FIGS. 2A and 3, respectively. Slots 90 can be formed in a lateral portion 96 of liner layer 88, in a top 98 portion of liner layer 88, or both. As such, at least a first portion of slots 90 can extend from a bottom edge 100 of liner layer 88 such that a continuous bottom edge 100 of the liner layer 88 forms a crenulated shape that extends along the bottom edge 100 and extends upwards through the lateral portion 96 of the liner layer 88 towards a central portion or the top portion 98 of liner layer 88. In some embodiments, liner layer 88 can further comprise a second portion of slots 90 that can extend from the top portion 98 or centerline of the liner layer 88 downwards towards the bottom edge 100. The second portion of the slots 90 can be formed at the top portion 98 in the form of a plus, star, or other shape with multiple intersecting slots. The first and second portions of slots 90 can also be alternately arranged or interleaved.

By including slots 90 to create the segmented liner layer 88, the liner layer 88 can, with or without a flexible outer shell, permit flexing, increase energy attenuation, and increase energy dissipation that might not otherwise be present or available. Advantageously, the liner layer 88 comprising slots 90 can provide or from boundary conditions at the interface between the liner layer 88 and the air or other material that fills or occupies the slots 90. The boundary conditions created by slots 90 can serve to deflect energy and change energy propagation through the helmet to beneficially manage energy dissipation at various conditions, including low-energy impacts, mid-energy impacts, and high-energy impacts. Furthermore, the liner layer 88 comprising slots 90 can also provide for adjustment of flex of liner layer 88, including bottom edge 100, to adjust and adapt to a shape of a user's head. Adjustment or flex of liner layer 88 and bottom edge 100 allows for adaptation of a standard sized liner layer 88 to better adapt to, match, and fit, idiosyncrasies of an individual user's head 72 that are not accommodated with conventional helmets 10, as described above in relation to FIG. 1.

Figure 4B:
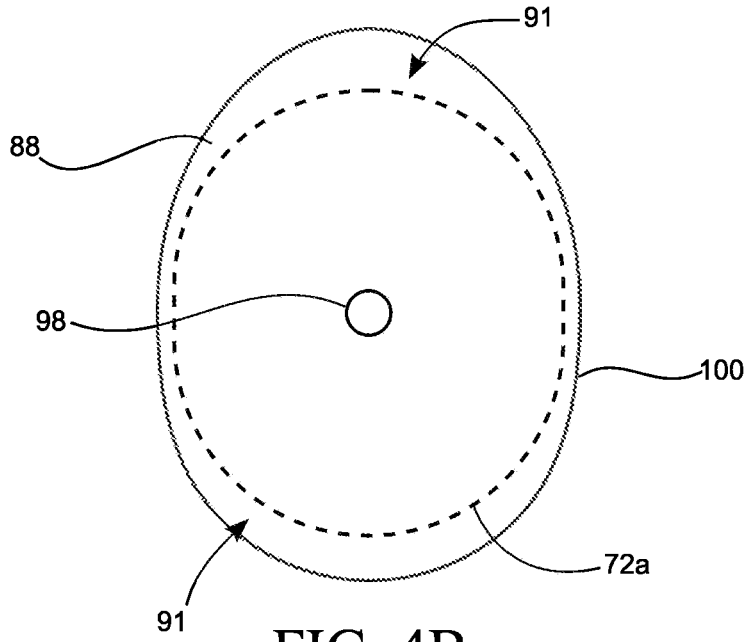

FIG. 4B shows a top plan view of the liner layer 88 being worn by a person with wide and short head 89*a*. Due to idiosyncrasies of wide and short head 89*a*, gaps or an offset 91 can exist between the head 89*a* and the liner layer 88. However, the flex of the liner layer 88 can allow for movement of the liner layer 88, including the bottom edge 100, to provide for adaptation of a standard sized liner layer 88 comprising a standard size to better adapt to, match, and fit, idiosyncrasies of head 89*a*, including during impacts.

Figure 4C:
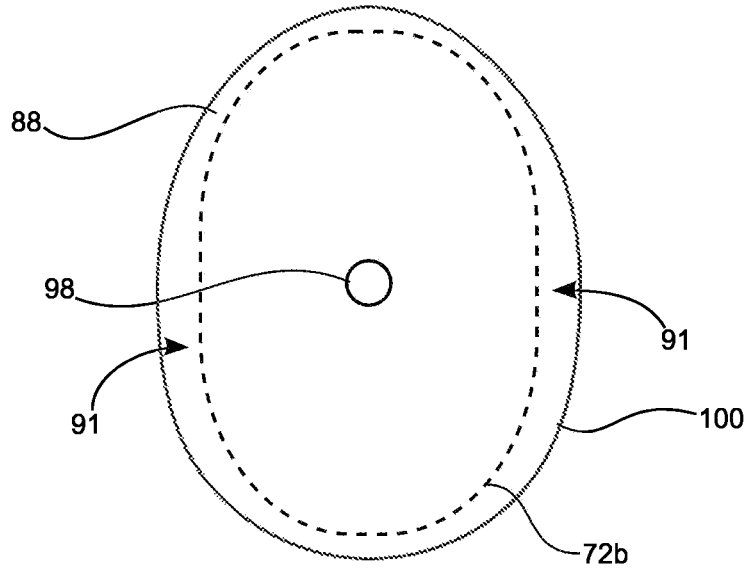

FIG. 4C shows a top plan view of the liner layer 88 being worn by a person with narrow and long head 89*b*. Due to idiosyncrasies of narrow and long head 89*b*, gaps or an offset 91 can exist between the head 89*b* and the liner layer 88. However, the flex of the liner layer 88 can allow for movement of the liner layer 88, including the bottom edge 100, to provide for adaptation of a standard sized liner layer 88 to better adapt to, match, and fit, idiosyncrasies of head 89*b*, including during impacts.

FIG. 5 illustrates a cross-sectional side view of a helmet 110 similar to the cross-sectional side view of helmet 70 shown in FIG. 3. As such, features or elements of helmet 110 that correspond to similar features in helmet 70 can be similar or identical to the corresponding elements such that all the disclosure and discussion presented above with respect to helmet 70 is applicable to helmet 110, unless specifically noted otherwise. For brevity, the details discussed above with respect to helmets 50 and 70 are not repeated here, but can be or are equally applicable to helmet 110, unless stated otherwise. Thus, the outer shell 74 and the multi-layer liner 76 comprising the outer-layer 78, the middle-layer 80, and the inner-layer 82 are analogous to the outer shell 114 and the multi-layer liner 116 comprising the outer-layer 118, the middle-layer 120, and the inner-layer 122, respectively. Similarly, slots, gaps, channels, or grooves 86 are analogous to the slots, gaps, channels, or grooves 126.

In light of the foregoing, FIG. 5 differs from FIG. 3 in at least two ways. First, the gap 84 between user head 72 and inner-layer 82 present with helmet 70 can be minimized or eliminated in helmet 110 so that an inner surface 122*a* of inner-layer 122 can contact user head 112, without the presence of a gap. Second, inner-layer 122 in helmet 110 includes a first portion directly attached to middle-layer 120 and a second portion directly attached to outer-layer 118, which is in contrast with the illustration of middle-layer 80 in FIG. 3 that does not directly attach to outer-layer 78.

With respect to the first difference of helmet 110 not comprising a gap between an inner surface of inner-layer 122 and user head 112, the gap can be avoided, or not created, by forming the topography of the inner surface of inner-layer 122 as a custom formed topography specially fitted to match a topography of user head 112. Accordingly, the custom-fitted multi-layer helmet of FIG. 4, in addition to providing the advantages described above, can also provide a custom fit that yields better comfort and better stability that standard helmets without a custom formed inner topography matching a topography of the user head 112.

With respect to the second difference of inner-layer 122 in helmet 110 including portions directly attached to both middle-layer 120 and outer-layer 118, coupling or attachment of layers within multi-layer liner 116 can occur similarly to the coupling of layers within multi-layer liner 76. For example, layers within multi-layer liner 116 can be coupled or directly connected chemically, mechanically, or both, using adhesives such as glue, or other suitable material, or with mechanical means such tabs, flanges, hook and loop fasteners, or other suitable fastening devices. As illustrated in FIG. 5, the middle-layer 120 can also be disposed between a portion, or less than an entirety, of an interface between the inner-layer 122 and the outer-layer 118. In an embodiment, a bushing, including a break away bushing, can be used to couple the inner-layer 122 to the outer-layer 118 near a top portion 128 of the helmet 110, which will fit, when worn, over a top portion of the user's head 112. The coupling of inner-layer 122 to outer-layer 118 can provide or facilitate a desirable amount of relative movement between the outer-layer 118 and the inner-layer 122 during a crash or impact while the helmet 1100 is absorbing or attenuating energy of the impact. The relative movement of various layers within the multi-layer liner 1166 with respect to the outer shell 114 of the helmet 110 or with respect to the user's head 112 can provide additional and beneficial energy management. An amount of relative movement, whether it be rotational, liner, or translational such as movement made laterally, horizontally, or vertically, can be varied based on how the liner layers are coupled to each other. Relative movement can occur for one or more types of energy management, including low-energy management, mid-energy management, and high-energy management.

Different configurations and arrangements for coupling the liner layers to each other are contemplated for controlling a relationship between impact forces and relative movement of the multiple liner layers, which can vary by application. Various layers of multi-layer liner 116 can be coupled, including directly attached, to each other chemically, mechanically, or both. The coupling of the various layers of the multi-layer liner 116 can comprise use of adhesives such as glue, or other suitable material, or with mechanical means such tabs, flanges, hook and loop fasteners, or other suitable fastening device. An amount, direction, or speed of relative movement among layers of the multi-layer liner 116 can be affected by how the layers are coupled. Advantageously, relative movement can occur in a direction, to a desired degree, or both, based on the configuration of the multi-layer liner 116, such as the middle-layer 120. The middle-layer 120, or another layer of the multi-layer liner 116, can also include slip planes within the multi-layer liner 116 for controlling or directing the relative movement.

In some embodiments, various layers of multi-layer liner 116 can be coupled to each other without the use of adhesives. As described above with respect to FIG. 3 and helmet 70, various layers of a multi-layer liner can also be coupled with padding snaps. The above discussion relative to helmet 70 and padding snaps 87 is also applicable to the helmet 110 and the multi-layer liner 116.

Any combination of the above features can be relied upon to provide the desired helmet performance metrics including low-energy, mid-energy, and high-energy absorption. Features to be adjusted include material properties such as flex, deformation, relative movement (rotational, translational, or both), and various operating conditions such as temperature or any other condition. As appreciated by a person of ordinary skill in the art, any number of various configurations can be created and beneficially applied to different applications according to desired functionality and the needs of various applications. The various configurations can include one or more of the following features as discussed above: (i) proportion adapting fit, (ii) customized fit, (iii) rotational protection, (iv) translation management (v) low-energy management, (vi) mid-energy management, (vii) high-energy management, (viii) energy deflection through changes in boundary conditions, and (ix) increased performance through pairing high and low density materials. In some embodiments, energy absorption through flexing can be achieved by an emphasis or priority on a softer inner-layer in which some low-energy benefit may be realized together with some rotational advantage. In other embodiments, an emphasis or priority on low-energy management can be achieved with more rotational advantage. Variously, specific advantages can be created based on customer or user end use.

Where the above examples, embodiments, and implementations reference examples, it should be understood by those of ordinary skill in the art that other helmet and manufacturing devices and examples could be intermixed or substituted with those provided. In places where the description above refers to particular embodiments of helmets and customization methods, it should be readily apparent that a number of modifications may be made without departing from the spirit thereof and that these embodiments and implementations may be applied to other helmet customization technologies as well. Accordingly, the disclosed subject matter is intended to embrace all such alterations, modifications and variations that fall within the spirit and scope of the disclosure and the knowledge of one of ordinary skill in the art.

The invention claimed is:

1. A protective sports helmet to be worn by a player engaged in a sport, the protective sports helmet comprising:
- an outer shell:
- a multi-layer liner assembly disposed within the outer shell, the multi-layer liner assembly including an inner-layer, a middle-layer, and an outer-layer;
  - wherein the inner-layer: (i) is positioned adjacent to the player's head when the protective helmet is worn by the player, (ii) includes a first material having a first chemical composition and a first density, and (iii) has an inner-layer thickness at a first location;
  - wherein the outer-layer: (i) is positioned adjacent to an inner surface of the outer shell, (ii) includes a second material having both: (a) a second chemical composition that is different from the first chemical composition, and (b) a second density that is greater than the first density, and (iii) has an outer-layer thickness at a second location that is greater than the inner-layer thickness; and
  - wherein a portion of the middle-layer is omitted from a region of the multi-layer liner assembly whereby said omission of the portion of the middle layer causes the inner-layer to abut an extent of the outer-layer in the region.

2. The protective sports helmet of claim 1, wherein the outer shell is configured to flex when the outer shell receives an impact.

3. The protective sports helmet of claim 1, wherein the first material of the inner-layer is configured to be less stiff than the second material of the outer-layer.

4. The protective sports helmet of claim 1, wherein the middle-layer includes: (i) a plurality of separate segments, and (ii) a third material having a third chemical composition that is different from the first chemical composition.

5. The protective sports helmet of claim 4, wherein the third chemical composition is different than the second chemical composition.

6. The protective sports helmet of claim 4, wherein outer-layer is includes a plurality of separate segments.

7. The protective sports helmet of claim 1, wherein the first material is a non-Newtonian shear thickening polymeric material.

8. The protective sports helmet of claim 1, wherein the inner-layer is comprised of a plurality of separate segments, and wherein a gap is positioned between a first segment contained in the plurality of separate segments and a second segment contained in the plurality of separate segments.

9. The protective sports helmet of claim 1, wherein the second density is greater than 50 g/L.

10. The protective sports helmet of claim 1, wherein the middle-layer has a thickness at a third location that is less than 4 millimeters.

11. The protective sports helmet of claim 1, wherein the multi-layer liner assembly permits relative rotational movement between said layers when the helmet is worn by the player and receives an impact.

12. The protective sports helmet of claim 1, wherein multi-layer liner assembly permits relative rotational movement between an extent of the helmet and the wearer's head when the helmet is worn by the player and receives an impact.

13. A protective sports helmet to be worn by a player engaged in a sporting activity, the protective sports helmet comprising:

an outer shell;

a multi-layer liner assembly disposed within the outer shell, the multi-layer liner assembly including an inner-layer and an outer-layer:

wherein the inner-layer: (i) a first material with a first density, and (ii) includes a plurality of separate segments, wherein each segments is mechanically secured within the multi-layer liner assembly; and wherein the outer-layer: (i) is positioned between the inner-layer and an inner surface of the outer shell, and (ii) includes a second material with a second density that is greater than the first density.

14. The protective sports helmet of claim 13, wherein the first material has a first chemical composition and the second material has a second chemical composition that is different from the first chemical composition.

15. The protective sports helmet of claim 13, wherein the outer shell includes at least one channel formed there through.

16. The protective sports helmet of claim 13, wherein the first material has a lower stiffness than the second material.

17. The protective sports helmet of claim 13, wherein the inner-layer includes an inner-layer thickness at a first location, wherein the outer-layer includes an outer-layer thickness at a second location that is greater than the inner-layer thickness, and wherein the first and second locations are aligned with one another.

18. The protective sports helmet of claim 13, further comprising a middle-layer: (i) that is positioned between an extent of the inner-layer and the outer-layer, and (ii) includes a middle-layer material having a middle-layer chemical composition that is different than an inner-layer chemical composition of the first material.

19. The protective sports helmet of claim 18, wherein the middle-layer includes a plurality of separate middle-layer segments, and wherein a middle-layer segment of the plurality of separate middle-layer segments is omitted from the multi-layer liner assembly.

20. The protective sports helmet of claim 19, wherein the inner-layer includes a non-Newtonian shear thickening polymeric material.

21. The protective sports helmet of claim 19, wherein said omission of the middle-layer segment causes the inner-layer to be positioned adjacent to an extent of the outer-layer in the region.

22. The protective sports helmet of claim 19, wherein outer-layer is includes a plurality of separate segments.

23. The protective sports helmet of claim 13, wherein multi-layer liner assembly permits relative rotational movement between said layers when the helmet is worn by the player and receives an impact.

24. The protective sports helmet of claim 13, wherein the outer shell is configured to flex when the outer shell receives an impact.

25. The protective sports helmet of claim 13, wherein multi-layer liner assembly permits relative rotational movement between an extent of the helmet and the wearer's head when the helmet is worn by the player and receives an impact.

26. The protective sports helmet of claim 13, further comprising a comfort-layer configured to be positioned adjacent between an extent of the player's head and the inner-layer.

27. A protective sports helmet to be worn by a player engaged in a sports activity, the protective sports helmet comprising:

an outer shell;

a multi-layer liner assembly disposed within the outer shell, the multi-layer liner assembly including an inner-layer and an outer-layer:

wherein the inner-layer: (i) includes an inner material with a first density and an inner-layer thickness at a first location, and (ii) includes an extent that is mechanically secured within the multi-layer liner assembly; and wherein the outer-layer: (i) is positioned adjacent to an inner surface of the outer shell, (ii) includes an outer material that: (a) is stiffer than the inner material, and (b) has a second density that is greater than the first density, and (iii) has a frontal thickness at a second location in a front region of the outer-layer that is different than a crown thickness at a third location in a crown region of the outer-layer.

28. The protective sports helmet of claim 27, further comprising a middle-layer that is positioned between an outer surface of the inner-layer and an inner surface of the outer-layer; and wherein middle-layer includes a middle-layer thickness at a fourth location that is less than both the inner-layer thickness and frontal thickness, wherein the fourth location is positioned between the first and third locations.

29. The protective sports helmet of claim 28, wherein the middle-layer thickness is less than 4 millimeters.

30. The protective sports helmet of claim 27, wherein the inner-layer thickness is less than the crown thickness.

31. The protective sports helmet of claim 30, wherein the inner material has a first chemical composition and the outer material has a second chemical composition that is different from the first chemical composition.

32. The protective sports helmet of claim 31, wherein the inner-layer includes an inner-layer region with a first density and the outer-layer includes an outer-layer region with a second density that is greater than the first density.

33. The protective sports helmet of claim 27, wherein the inner-layer includes a plurality of separate segments and the inner material has a density that is greater than 30 g/L.

34. The protective sports helmet of claim 27, further comprising a middle-layer that is positioned between the inner-layer and the outer-layer, and wherein a portion of the middle-layer is omitted from a region of the multi-layer liner assembly, said omission of the portion of the middle layer causes an extent of the inner-layer to abut an extent of the outer-layer in the region.

35. The protective sports helmet of claim 27, wherein the inner-layer includes a non-Newtonian shear thickening polymeric material.

36. The protective sports helmet of claim 27, wherein the protective sports helmet is configured to deform when the protective sports helmet receives an impact.

37. The protective sports helmet of claim 27, wherein multi-layer liner assembly permits relative rotational movement between an extent of the helmet and the wearer's head when the helmet is worn by the player and receives an impact.

38. The protective sports helmet of claim 27, further comprising a comfort-layer positioned adjacent between an extent of the player's head and the inner layer.

39. The protective sports helmet of claim 27, wherein outer-layer is includes a plurality of separate segments.

40. The protective sports helmet of claim 39, further comprising a middle-layer: (i) that is positioned between the inner-layer and the outer-layer; and (ii) including a plurality of separate segments.

* * * * *